US012704343B2

(12) United States Patent
Wynalda, Jr. et al.

(10) Patent No.: US 12,704,343 B2
(45) Date of Patent: Aug. 11, 2026

(54) SHOOTING REST AND SUPPORT SYSTEM

(71) Applicant: Fourth Arrow, LLC, Comstock Park, MI (US)

(72) Inventors: Robert M. Wynalda, Jr., Comstock Park, MI (US); Mark Wynalda, Comstock Park, MI (US)

(73) Assignee: Fourth Arrow , LLC, Comstock Park, MI (US)

( * ) Notice: Subject to any disclaimer, the term of this patent is extended or adjusted under 35 U.S.C. 154(b) by 290 days.

(21) Appl. No.: 18/112,055

(22) Filed: Feb. 21, 2023

(65) Prior Publication Data

US 2023/0280123 A1 Sep. 7, 2023

Related U.S. Application Data

(63) Continuation-in-part of application No. 17/203,115, filed on Mar. 16, 2021, now Pat. No. 11,585,624, which is a continuation-in-part of application No. 16/729,950, filed on Dec. 30, 2019, now Pat. No. 10,962,321.

(60) Provisional application No. 62/832,488, filed on Apr. 11, 2019, provisional application No. 62/789,071, filed on Jan. 7, 2019, provisional application No. 62/787,115, filed on Dec. 31, 2018.

(51) Int. Cl.
*F41A 23/06* (2006.01)
*F41A 23/16* (2006.01)

(52) U.S. Cl.
CPC ..... *F41A 23/06* (2013.01); *F41A 23/16* (2013.01)

(58) Field of Classification Search
CPC ..... F41A 23/10; F41A 23/06; F41A 23/16
USPC ..... 42/94, 90; 89/37.04, 37.03; 73/167
See application file for complete search history.

(56) References Cited

U.S. PATENT DOCUMENTS 1,233,638 A * 7/1917 Bearman ..... F16M 11/10 248/292.12
2,870,683 A * 1/1959 Wilson ..... F41A 23/12 89/37.04
3,473,673 A * 10/1969 Porter ..... A47B 81/005 211/64
4,967,497 A * 11/1990 Yakscoe ..... F16M 11/34 42/94
5,697,181 A * 12/1997 Savant ..... B62J 11/00 224/420
6,142,349 A * 11/2000 Roberson ..... B60R 7/14 224/558
7,959,116 B2 * 6/2011 Carnevali ..... F16M 11/40 248/163.1

(Continued)

*Primary Examiner* — Reginald S Tillman, Jr.
(74) *Attorney, Agent, or Firm* — Fred Zollinger

(57) ABSTRACT

A shooting rest for different weapons provides ends that are offset from the central portion of the rest to provide a space that accommodates a portion of the weapon being used with the rest. The shooting rest can be used with one or two supports that engage the weapon being used with the rest. Each support includes pliable arms that can be configured by the user to a custom shape. Each arm has an inner member that can be bent with no or little spring back to allow the user to shape the arm to a desired configuration. When in use, the entire rest can be tilted about its main support. A support assembly includes an adjustable arm that carries the shooting rest from the top of a monopod that is anchored to allow repositionable use without interference with the hunter's legs.

14 Claims, 28 Drawing Sheets

(56) References Cited

U.S. PATENT DOCUMENTS

| | | | | |
|---|---|---|---|---|
| 10,724,557 | B2 * | 7/2020 | Banes | F16B 2/12 |
| 2003/0066937 | A1 * | 4/2003 | Smith | H01H 9/025<br>248/176.1 |
| 2011/0177752 | A1 * | 7/2011 | Patsiner | F16M 11/40<br>248/188.8 |
| 2012/0227305 | A1 * | 9/2012 | Fontenot | F41A 23/02<br>42/94 |
| 2014/0237882 | A1 * | 8/2014 | Banes | F41A 23/16<br>42/94 |
| 2015/0226370 | A1 * | 8/2015 | Amussen | F16M 11/16<br>29/525.01 |
| 2016/0153743 | A1 * | 6/2016 | Hawkins | F41A 23/10<br>42/71.01 |

* cited by examiner

SHOOTING REST AND SUPPORT SYSTEM

CROSS REFERENCE TO RELATED APPLICATIONS

This application is a continuation-in-part application claiming priority to U.S. patent application Ser. No. 17/203,115 filed Mar. 16, 2021, U.S. Pat. No. 11,585,624, Feb. 21, 2023, which is a continuation-in-part application claiming priority to U.S. patent application Ser. No. 16/729,950 filed Dec. 30, 2019, U.S. Pat. No. 10,962,321, Mar. 30, 2021, which application claims the benefit of U.S. provisional patent application Nos. 62/787,115 filed Dec. 31, 2018; 62/789,071 filed Jan. 7, 2019; and 62/832,488 filed Apr. 11, 2019; the disclosures of each application are incorporated herein by reference.

BACKGROUND OF THE DISCLOSURE

1. Technical Field

This disclosure generally relates to shooting rests and support systems that support devices such as guns and cross bows.

2. Background Information

Shooting rests are used to hold a device steady during sight adjustment, hunting, shooting competitions, and target practice.

SUMMARY OF THE DISCLOSURE

The disclosure provides a shooting rest for weapons such as rifles and crossbows. In one configuration, the support assemblies of the shooting rest are offset from a central portion of a base to provide a space that accommodates a portion of the weapon being used with the rest.

In another configuration, the shooting rest can be used with one or two support members that support the weapon being used with the rest. The arrangement of each support member can be adjusted and then fixed by the user. Each support member can be rotated about a vertical axis and tilted about a horizontal axis. Each support can be tilted inwardly toward one another to a storage position for storage and transport of the shooting rest. When combined with the offset base ends, the overall shooting rest is compact for storage and transport. When in use, the entire shooting rest can be rotated about its main support and also tilted up and down.

The disclosure provides support member or yoke configurations that are configurable and then reconfigurable by the user. Each includes at least two bendable arms that extend from a base. The exemplary configurations use four arms. Each arm can be formed to a configuration that is custom to the gun or bow being used with the shooting rest. If a different gun or bow is used at a different time, the arms can be reconfigured for use with the next gun or bow. The arms have an inner pliable member covered by a protective outer layer. The arms can be metal covered with a polymer such as silicone or rubber. In one configuration, the interior arms are made from thin metal such as steel bars and the entire device is coated with a silicone protective layer.

The disclosure also independently provides a weapon support member configuration that includes a plurality of spaced, flexible ribs supported from a rigid body member. The support member includes corner ribs disposed across the flexible ribs. The corner ribs are curved and define a spaced between them to receive the typical shape of a weapon stock that is disposed behind the pistol grip.

The disclosure also provides a shooting rest assembly wherein the shooting rest is carried at the outer end of an adjustable arm with the inner end of the arm supported by a monopod to allow the shooting rest to be used inside the limited space of a hunting blind with interfering with the hunter's legs or hunter's chair. The assembly allows the weapon to be swung about to different shooting angles without removing the weapon from the rest. In the configuration of the assembly including an arm having three arm portions, the hunter can swing the weapon from a left window, across a front window, all the way to a right window and back again without removing the weapon from the rest or changing the location of the rest mount. In this configuration, the arm includes three arm portions with the outer arm portion being configured to rotate above the middle arm portion.

The disclosure further provides an anchor that secures a monopod to a mounting structure such as a hunting blind or a tree stand. The monopod and anchor allow the useful height of the monopod to be adjusted above the anchor.

The disclosure further provides a camera mount for the shooting rest wherein a mounted camera moves with the weapon carried by the shooting rest.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
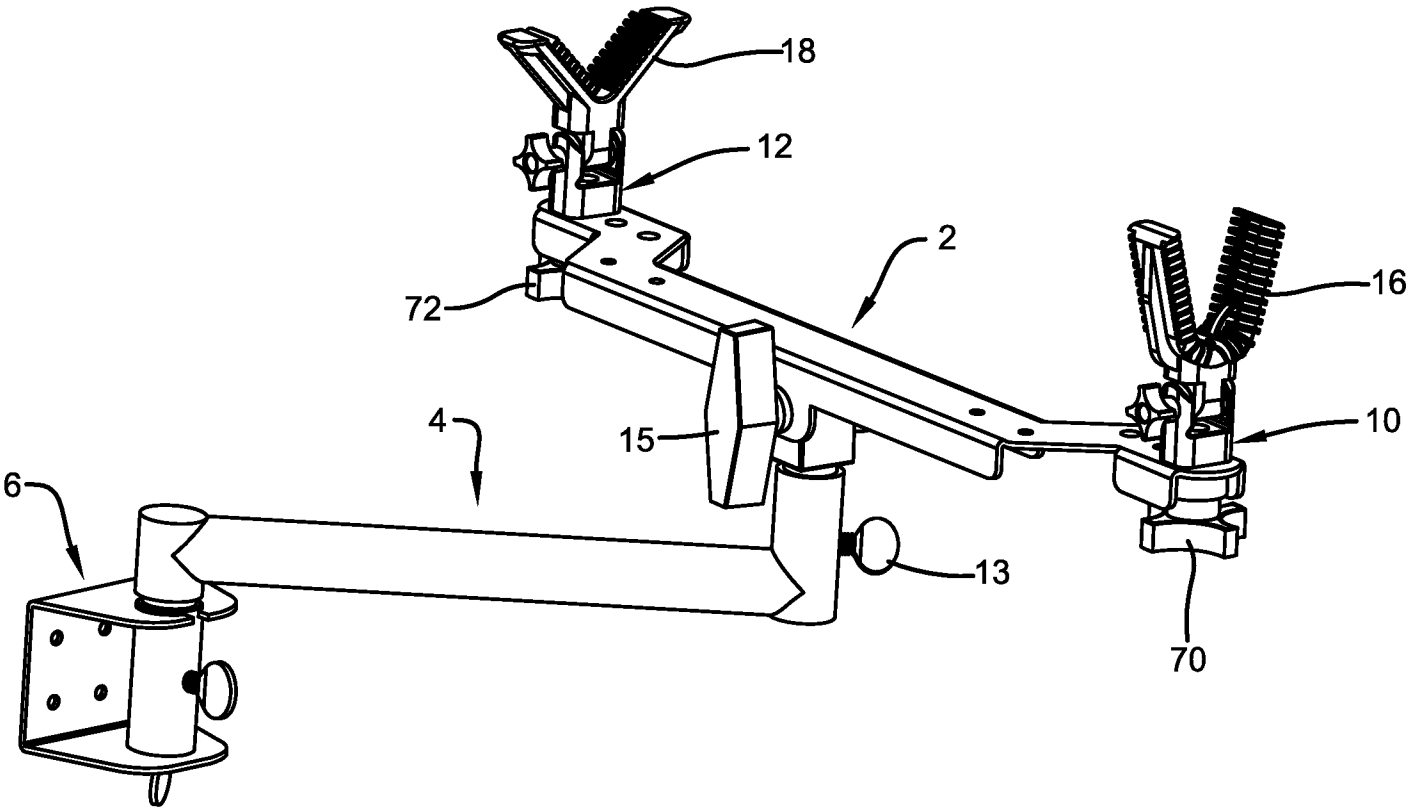
FIG. 1 is a perspective view of an exemplary shooting rest configuration of this disclosure carried on the end of an arm.
Figure 18:
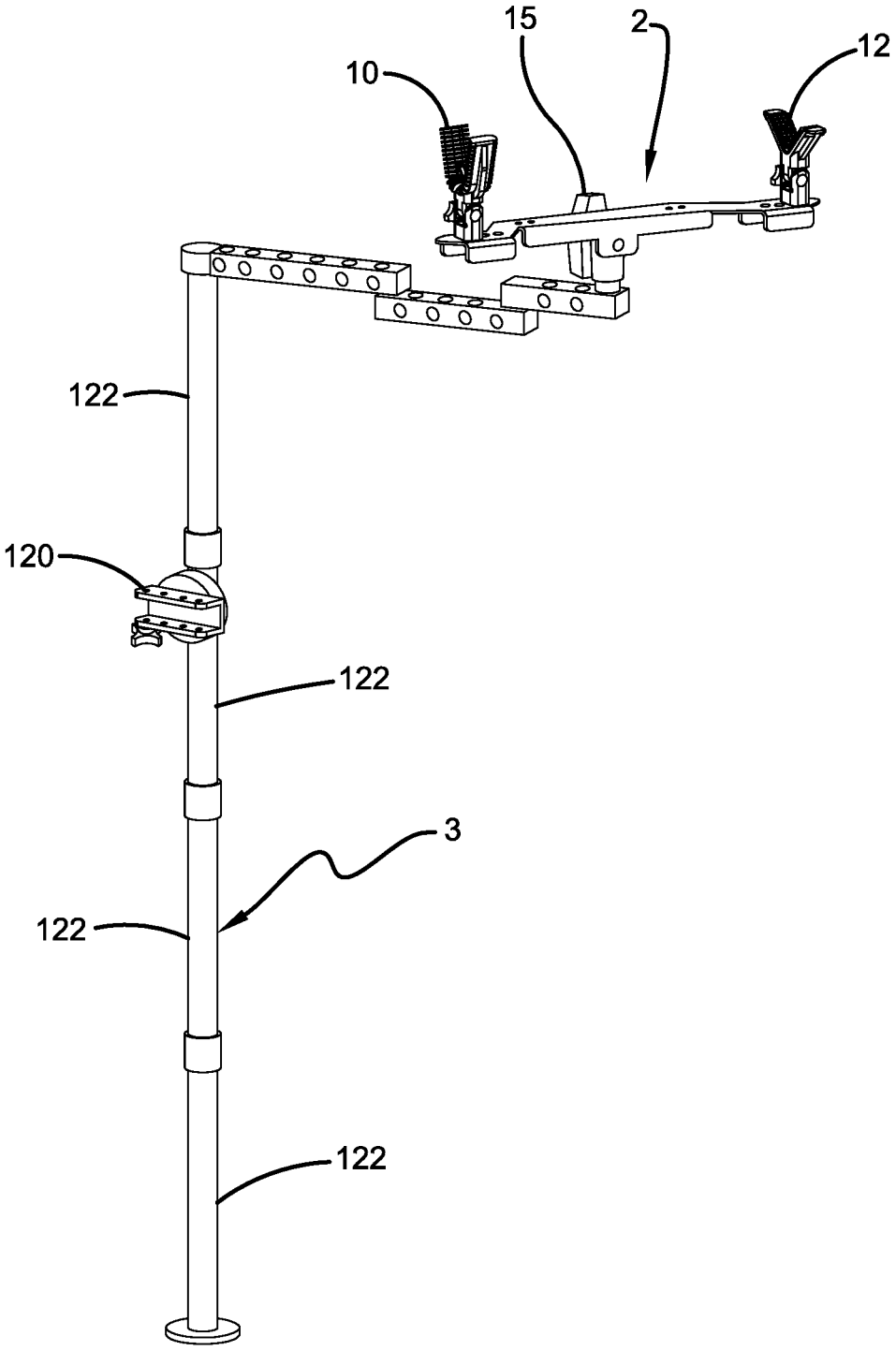
FIG. 18 is a perspective view of the shooting rest carried on a hinged arm that is carried by a monopod.
Figure 19:
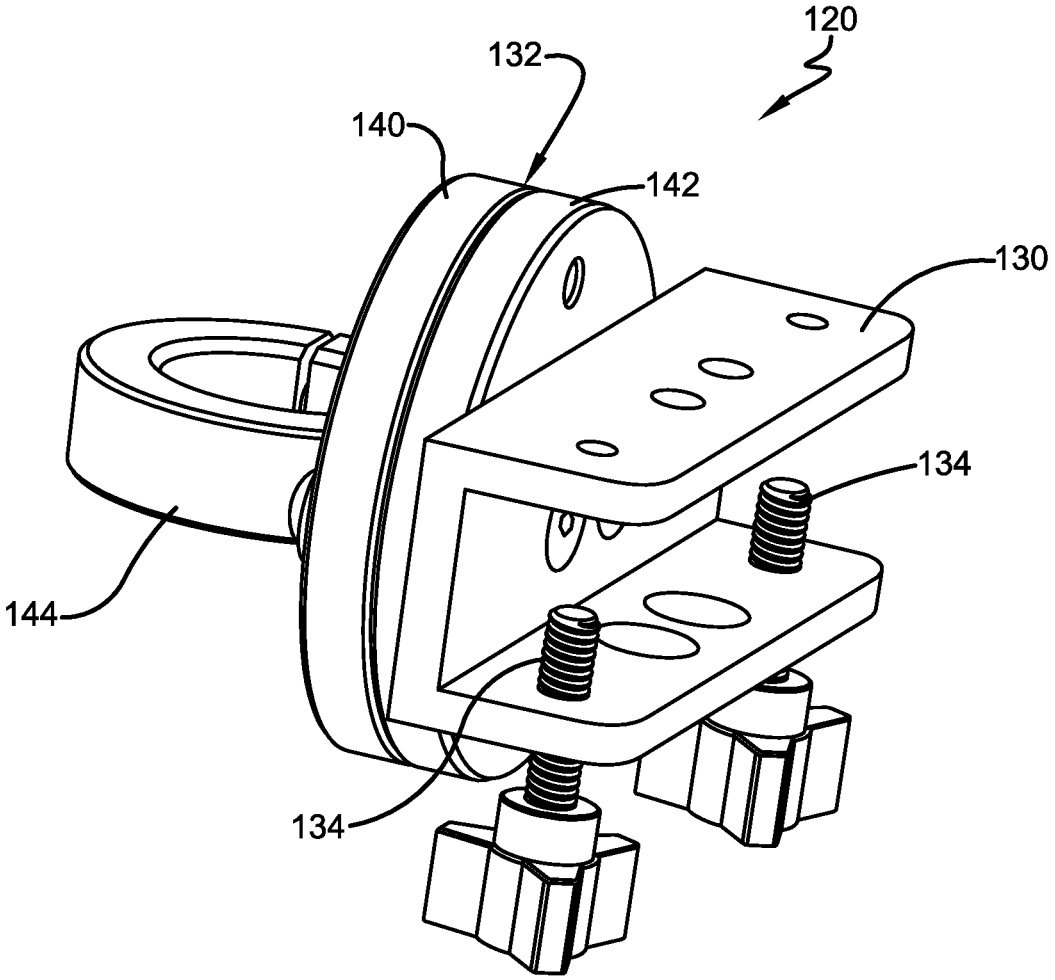
FIG. 19 is a perspective view of an anchor for the monopod.
Figure 20:
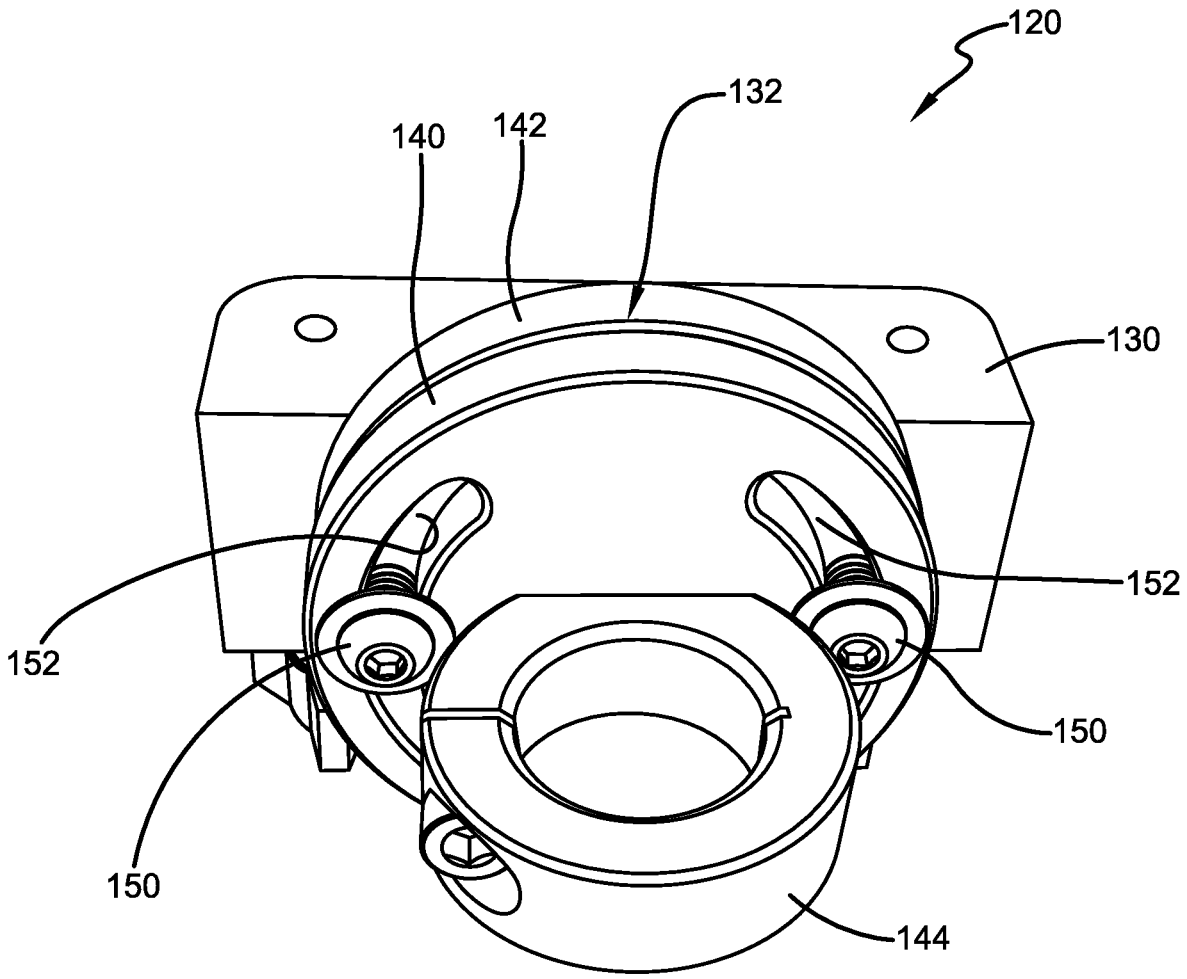
FIG. 20 is another perspective view of the anchor of FIG. 19.

An exemplary configuration of a shooting rest of the disclosure is indicated generally by the reference numeral 2 in the accompanying drawings. Shooting rest 2 can be supported on a variety of supports such as tables, tripods, monopods 3 (FIG. 18), or an arm 4 as depicted in FIG. 1 or a multiple-section hinged arm 5 as depicted in FIG. 18. Such arms 4 and 5 can be mounted with a bracket 6 to the side of a hunting blind, to a tree stand, or to a tree branch near a tree stand.

Figure 21:
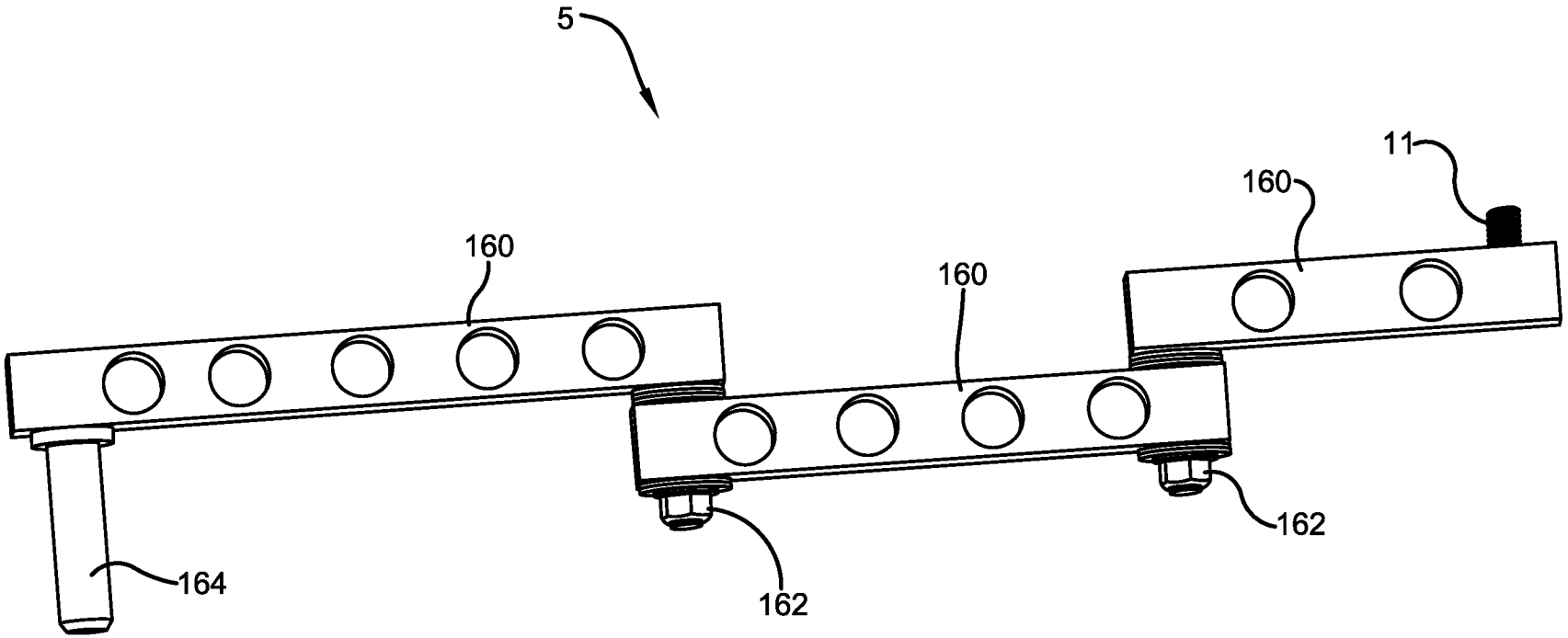
FIG. 21 is a side view of the hinged arm.
Figure 22:
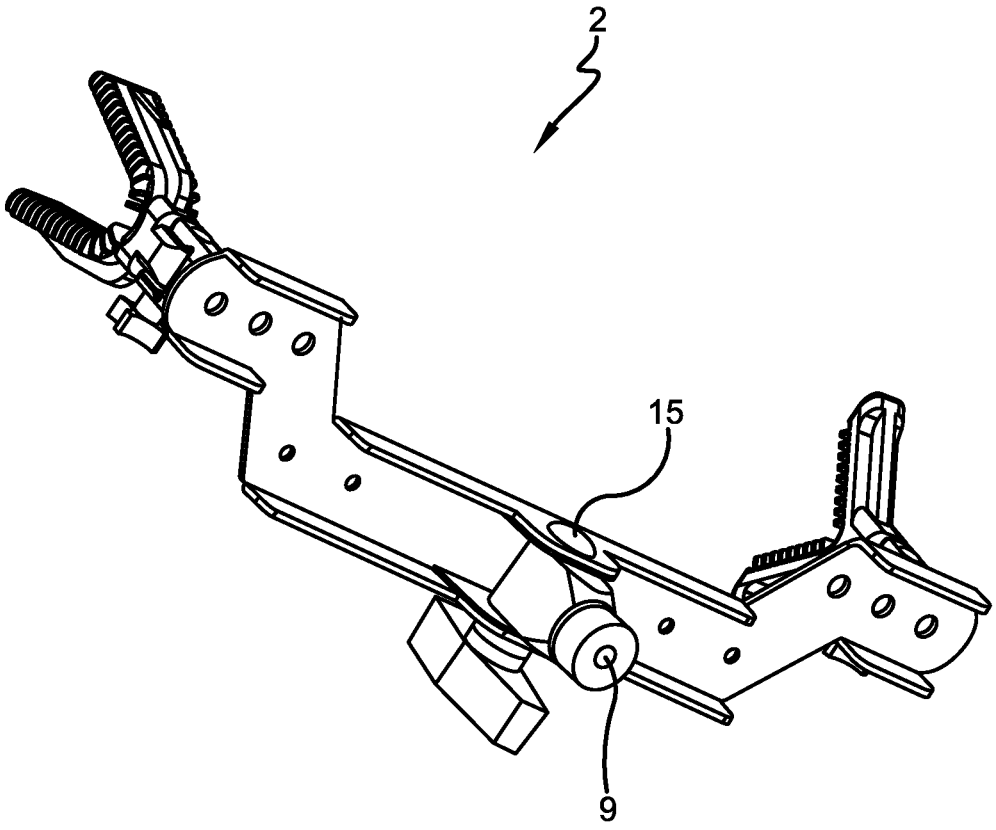
FIG. 22 is a bottom perspective view of the shooting rest showing the threaded mount that allows it to be secured to the arm.

One exemplary configuration of shooting rest 2 includes a mounting rod 8 that slides into an opening defined by the end of arm 4 to allow shooting rest 2 rotate with respect to arm 4 about an axis defined by the longitudinal dimension of mounting rod 8. Another exemplary configuration of shooting rest 2 defines a threaded opening 9 (FIG. 22) carried in a rotating element of rest 2 that receives a threaded mounting screw 11 (FIG. 21). This assembly also allows shooting rest 2 to rotate about the axis defined by the longitudinal dimension of threaded mounting screw 11. Rest 2 can be tightened down on threaded mounting screw 11 while still allowing the upper portions of rest 2 to rotate 360 degrees. A thumb screw 13 (FIG. 1) can be used to lock the position of mounting rod 8 with respect to arm 4 or to just prevent mounting rod 8 from lifting out of arm 4 while permitting rotational movement.

Figure 23:
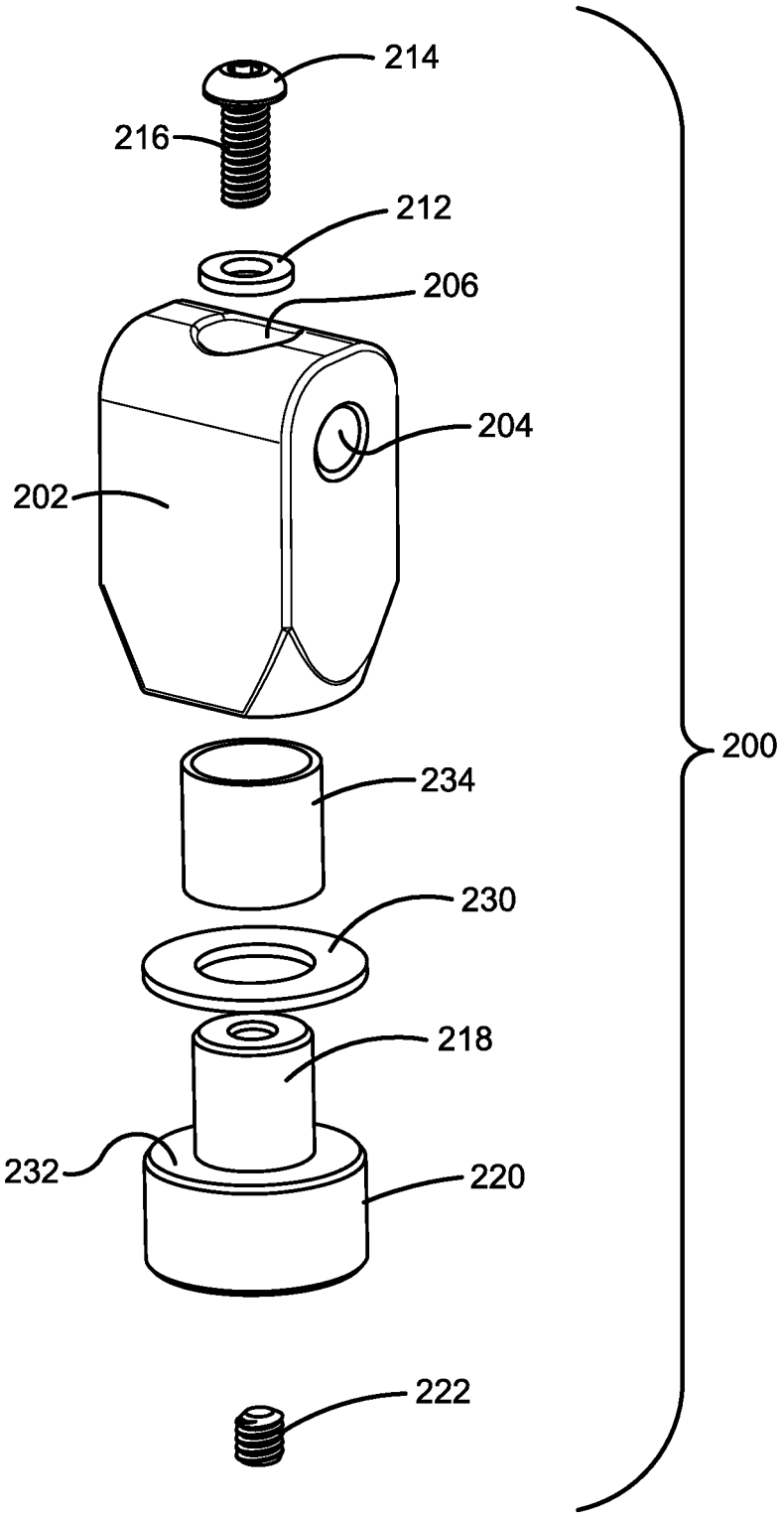
FIG. 23 is an exploded view of a swivel mount for the shooting rest.
Figure 24:
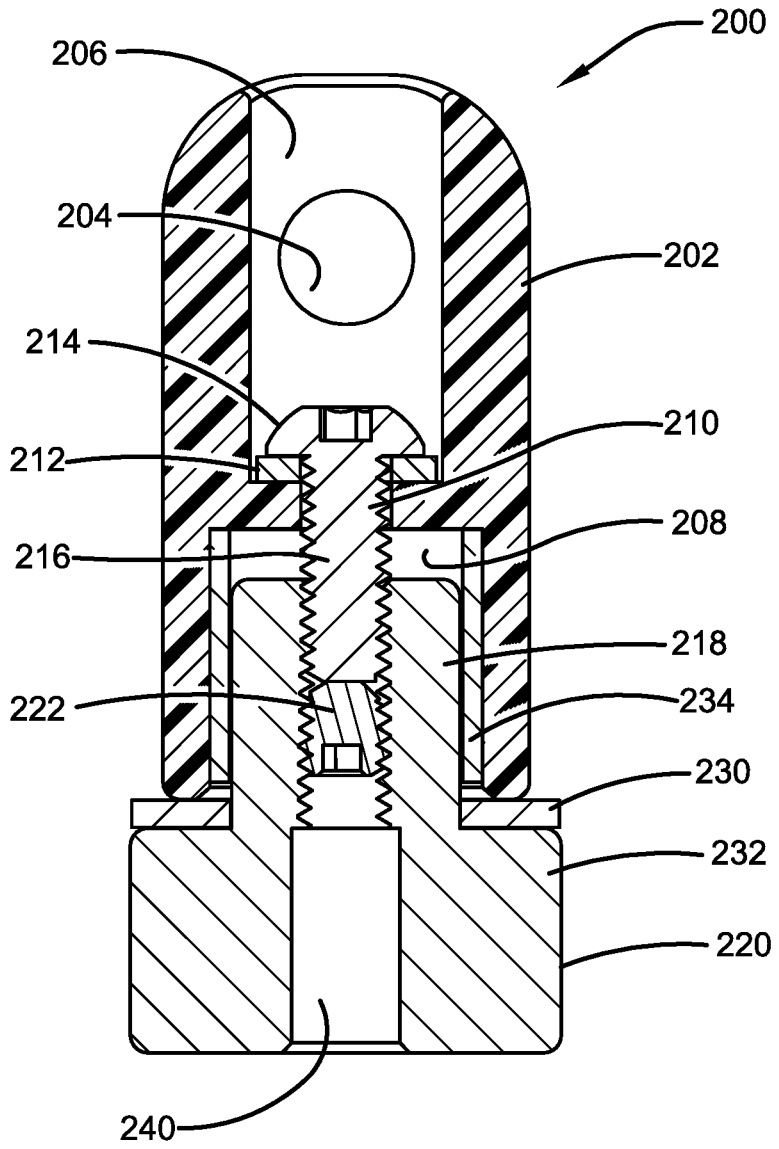
FIG. 24 is a section view of the swivel mount of FIG. 23.

A swivel mount 200 for shooting rest 2 is depicted in FIGS. 23-24. Shooting rest 2 is selectively clamped to the upper body 202 of swivel mount 200 with pivot mount 15 which allows the user to tilt shooting rest 2 about the axis of pivot mount 15 and to lock rest 2 in the selected tilted arrangement. Pivot mount 15 includes a pivot rod that is disposed in a pivot channel 204 defined by upper body 202. Upper body 202 also defines an upper recess 206 and a lower recess 208 with a fastener opener 210 between the two. Upper recess 206 receives a fastener washer 212 and a fastener head 214 of a fastener 216. Fastener 216 extends through opening 210 into lower recess 208 where it threadedly engages a threaded shank 218 of a lower body 220 to rotatably connect upper body 202 to lower body 220. A set screw 222 is disposed below fastener 216 and engages the bottom of fastener 216 to stop it from tightening upper body 202 against lower body 220. A body washer 230 is disposed between the bottom of upper body 202 and a shoulder 232 of lower body 220. A sleeve bearing 234 is disposed between shank 218 and the inner surface of upper body 202 that defines lower recess 208. Lower body 220 defines a mount opening 240 which receives a mounting stud. Mount opening 240 can be threaded or unthreaded as shown. When installed, swivel mount 200 allows upper body 202 to fully rotate 360 degrees about lower body 220 on washer 230 and sleeve 234. Washer 230 and sleeve 234 provide smooth, quiet rotation while minimizing looseness between upper 202 and lower 220 bodies.

Figure 6:
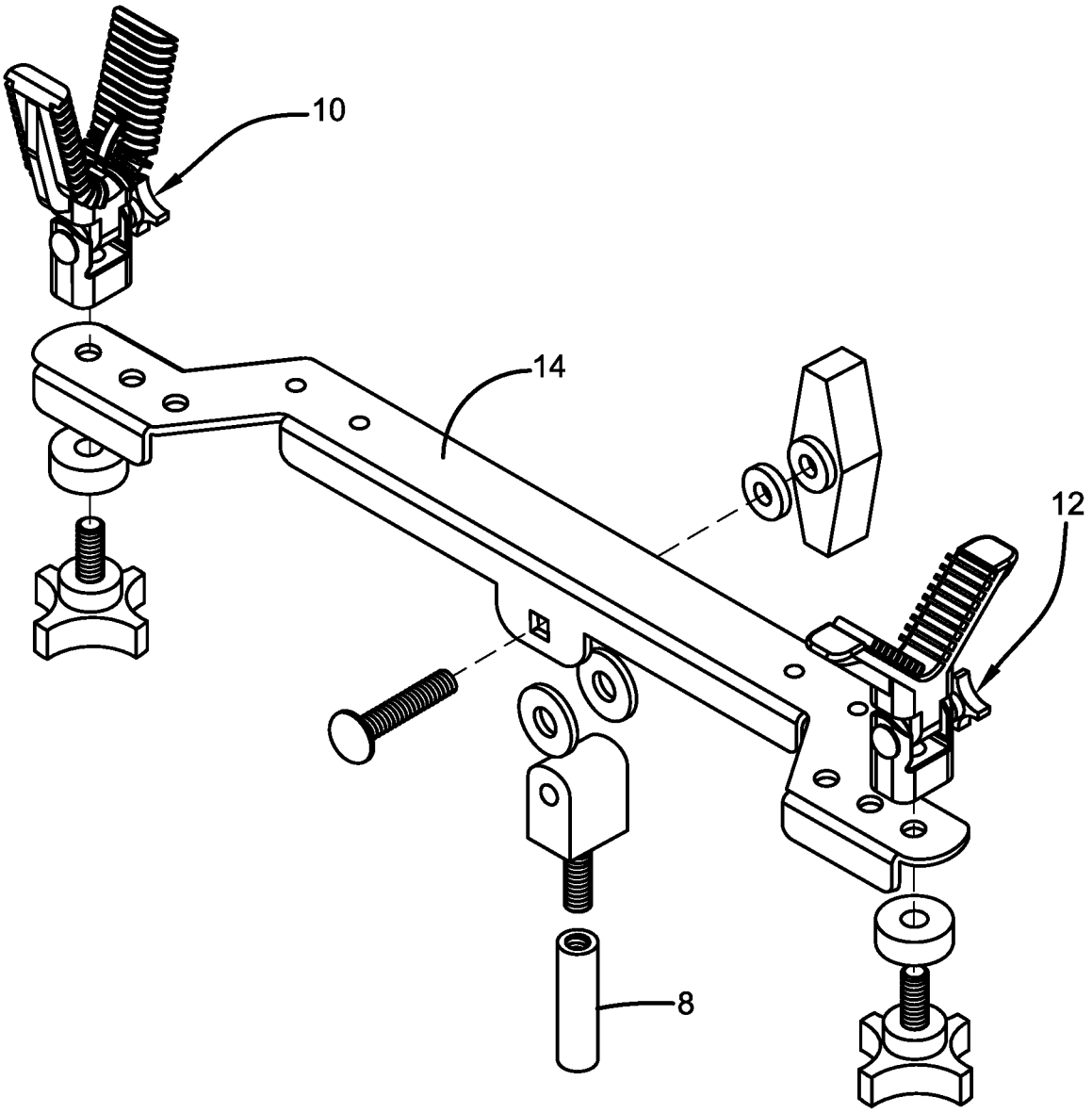
FIG. 6 is an exploded perspective view thereof.
Figure 7:
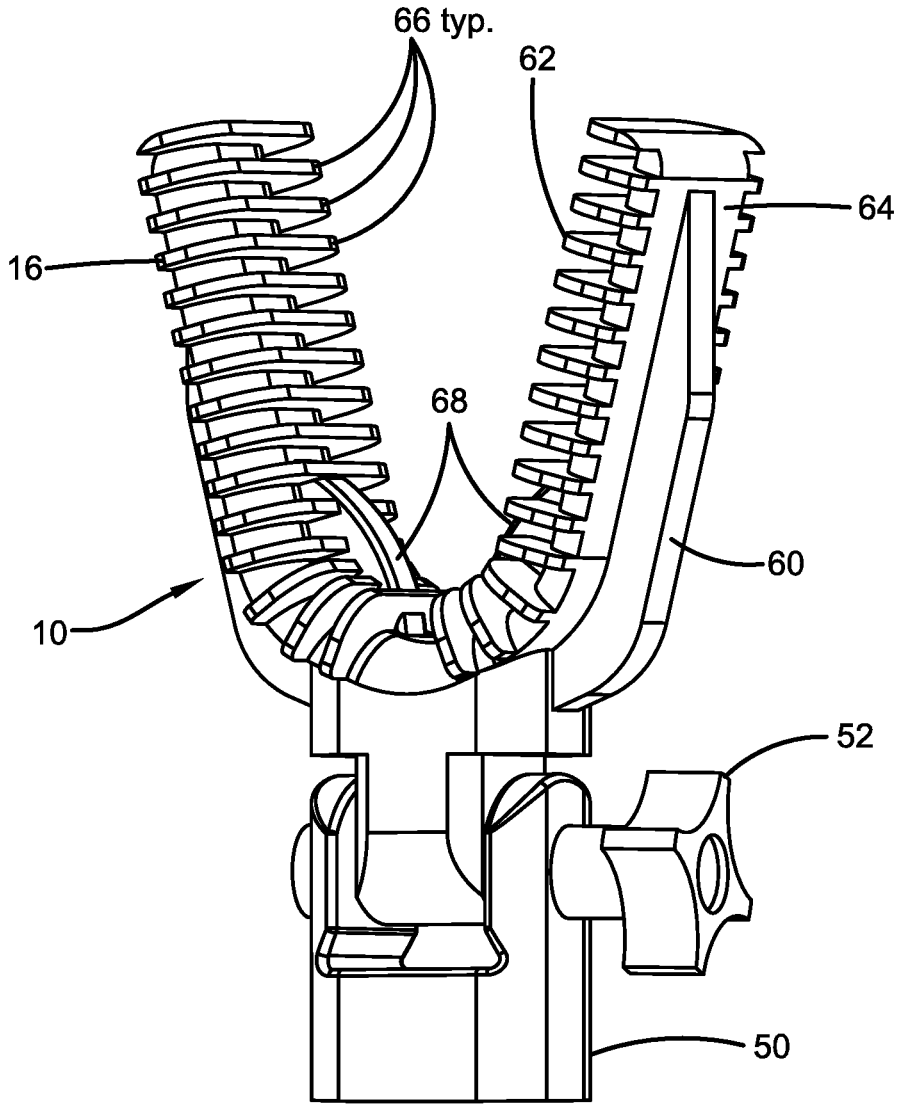
FIG. 7 is a perspective view of the U support assembly.

The upper portions of shooting rest 2 can be selectively tilted up and down with respect to mounting rod 8 or threaded mounting screw 11. A selectively clamped pivot mount 15 (FIGS. 1 and 6) is used to permit the tilting of rest 2 and to lock it in the desired tilted position.

Other mounting configurations do not have to provide the rotation or the tilt. Shooting rest 2 can be fixed to a support such as a tripod or table when in use. Shooting rest 2 is used to support a weapon such as a rifle, a shotgun, or a cross bow while the shooter aims and fires the weapon. Shooting rest 2 can reduce fatigue when hunting and improve accuracy.

Shooting rest 2 includes first 10 and second 12 support assemblies upon which the weapon being supported is rested upon during use. A user can elect to remove one of the support assemblies and use rest 2 with only a single support assembly. In the exemplary configurations, shooting rest 2 includes a U support assembly 10 at the rear of rest 2 and a V support assembly 12 at the front of rest 2. In other configurations, rest 2 can be configured with a pair of U support assemblies or a pair of V support assemblies. Also, depending on the configuration of the weapon being used with rest 2, U support assembly 10 can be disposed at the front or rear of rest with V support assembly 12 disposed at the other end.

Support assemblies 10 and 12 are carried by a base 14 in a spaced configuration. Each support assembly 10 and 12 is mounted to base 14 in a manner that allows the upper support portion (U support 16 and the V support 18) of the support assembly to be rotated down to toward each other (arrows 20 in FIG. 2) to be substantially parallel to base 14 without contacting each other to provide a compact configuration for storage and transport. In FIGS. 1-6, both supports 16 and 18 are substantially perpendicular to base 14 with their openings aligned to receive front and rear portions of the weapon to be supported by shooting rest 2. The position of both supports 16 and 18 can be adjusted about a first axis (their vertical axes in the drawings) (22 and 24) through 360 degrees of adjustment. The position of both supports 16 and 18 also can be adjusted about a second axis that is perpendicular to the first axis (the second axis is the horizontal axis in the drawings) (26 and 28). These adjustments allow a single support 16 or 18 to be used. These adjustments allow the user to tilt a support 16 or 18 forward or rearward to locate it in a more comfortable position or into a position that is less visually distracting.

Figure 2:
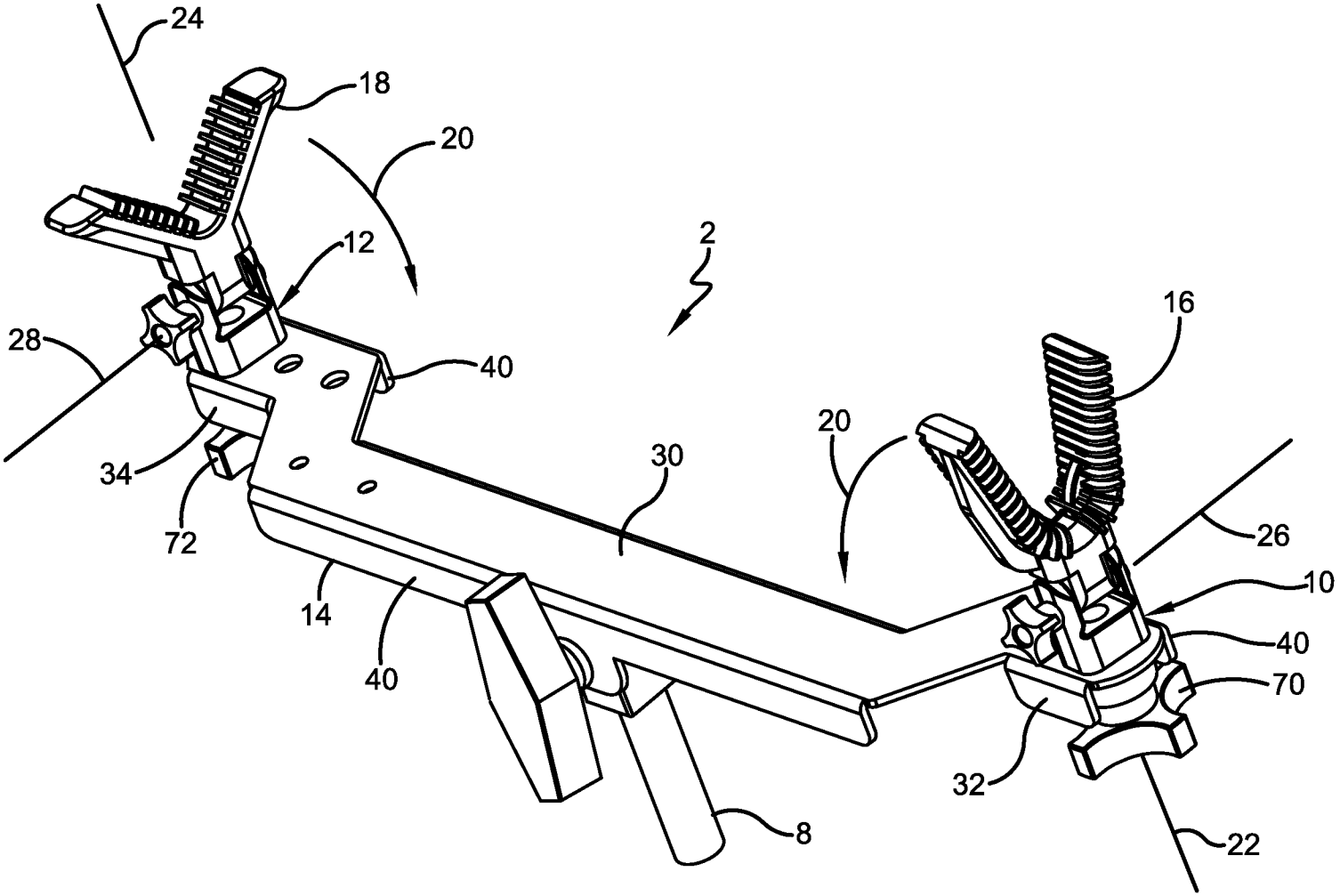
FIG. 2 is a perspective view of the configuration of the shooting rest of FIG. 1.
Figure 3:
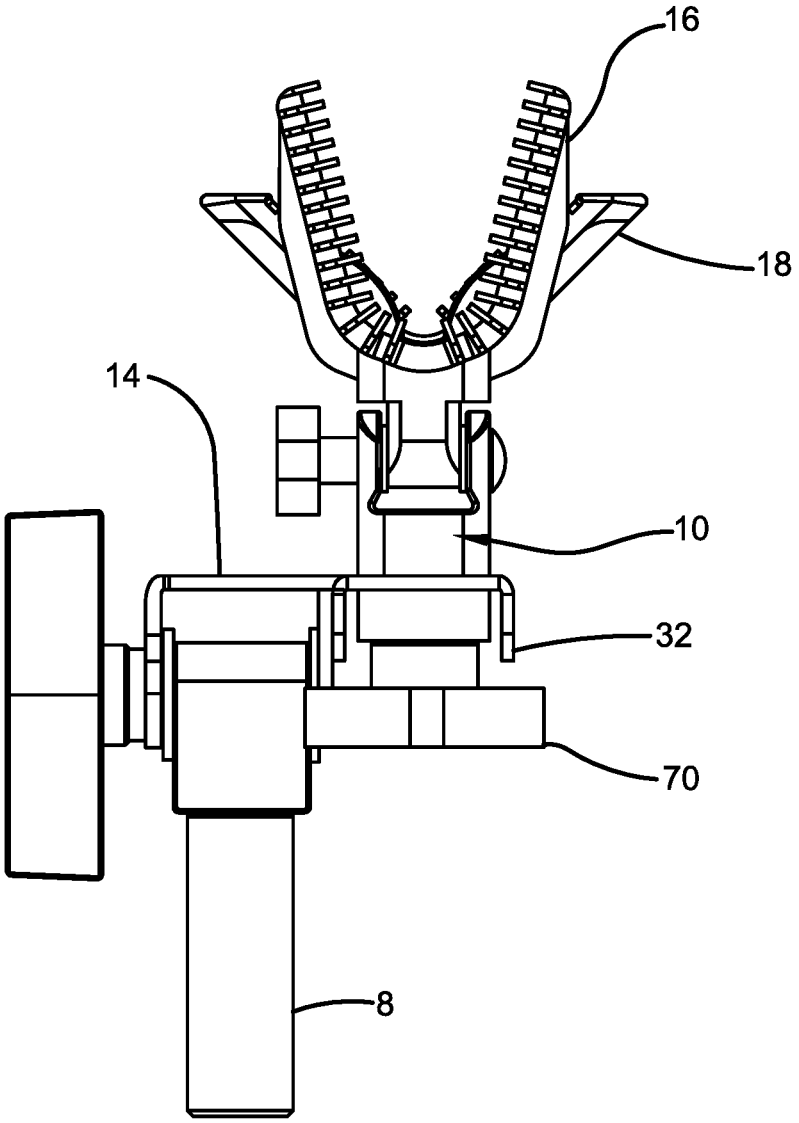
FIG. 3 is a rear elevation view of the shooting rest of FIG. 2.
Figure 4:
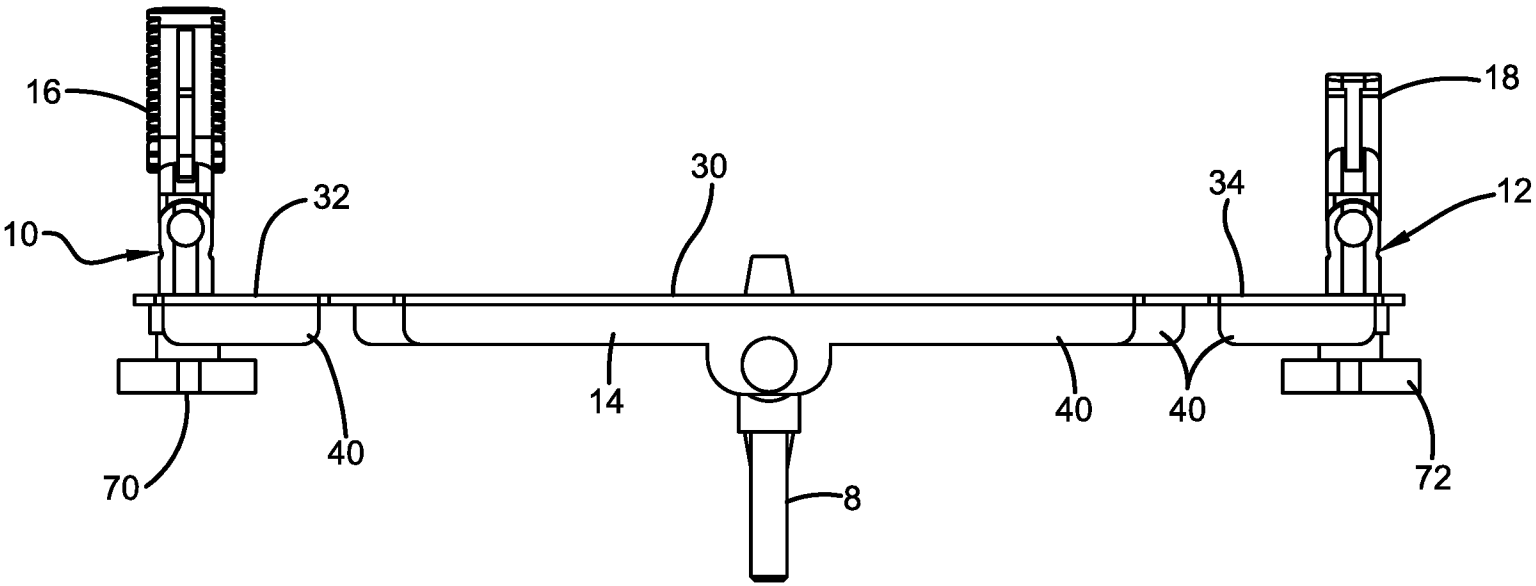
FIG. 4 is a left side elevation view thereof.
Figure 5:
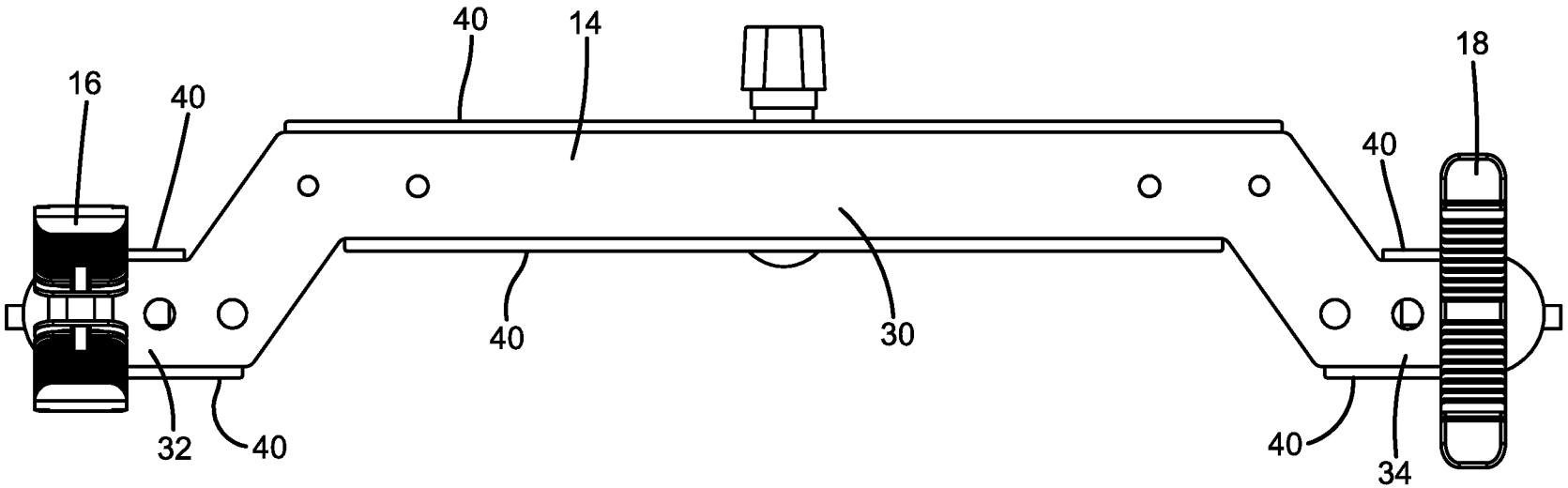
FIG. 5 is a top plan view thereof.

Support assemblies 10 and 12 are carried by offset ends 32 and 34 that are laterally spaced from the central portion 30 of base 14. As can be seen in FIGS. 2 and 5, the offset ends 32 and 34 provide an empty space directly between ends 32 and 34 adjacent central portion 30. The offset is sufficient such that a straight reference line through the center of each support 16 and 18 will not pass through central portion 30 when viewed from a top plan view such as that shown in FIG. 5. This empty space provides room for portions of the weapon being supported by shooting rest 2. For example, an ammunition clip or a pistol grip can extend down from a weapon into this empty space. In the exemplary configuration, each end 32 and 34 is fully offset from central portion 30 as shown in FIGS. 3 and 5.

Base 14 has a flat upper wall with sidewall portions 40 disposed along central portion 30 and ends 32 and 34. As shown in FIGS. 3 and 5, the inner sidewall portions 40 of ends 32 and 34 are disposed just outside of the outer sidewall portion 40 of central portion 30. Base 14 defines a plurality of mounting openings at each offset end 32 and 34 for each support assembly 10 and 12 to allow shooting rest 2 to be configured for different weapons. Base 14 also defines mounting openings at the ends of central portion 30 to allow support assemblies 10 and 12 to be mounted at the ends of central portion 30 if desired. When support assemblies 10 and 12 are mounted to center portion 30, the empty space described above is not provided.

FIGS. 7-9 and 13 show the structure of U support assembly 10. U support 16 is selectively pivotably carried on a U support base 50. A threaded clamp 52 is used to selectively lock the position of U support 16 with respect to U support base 50. The pivot provided by clamp 52 is about horizontal axis 26.

Figure 8:
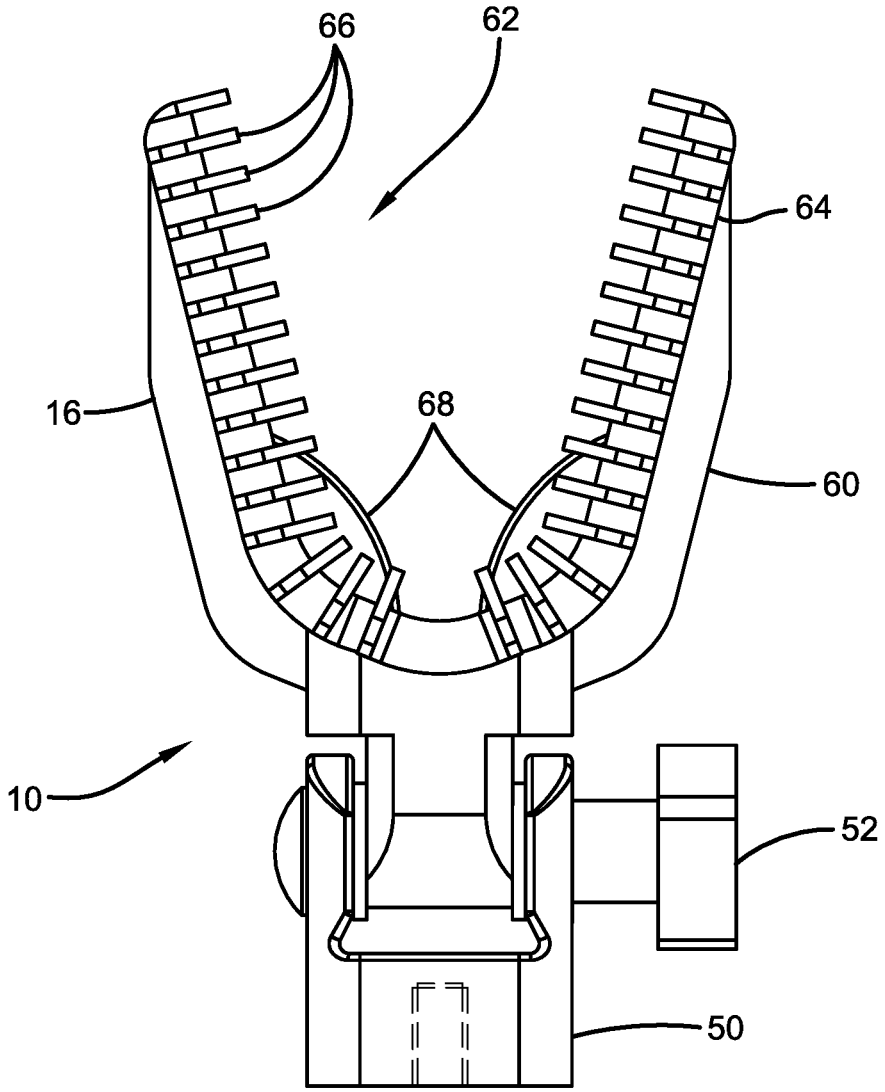
FIG. 8 is a front elevation view of the U support assembly.
Figure 9:
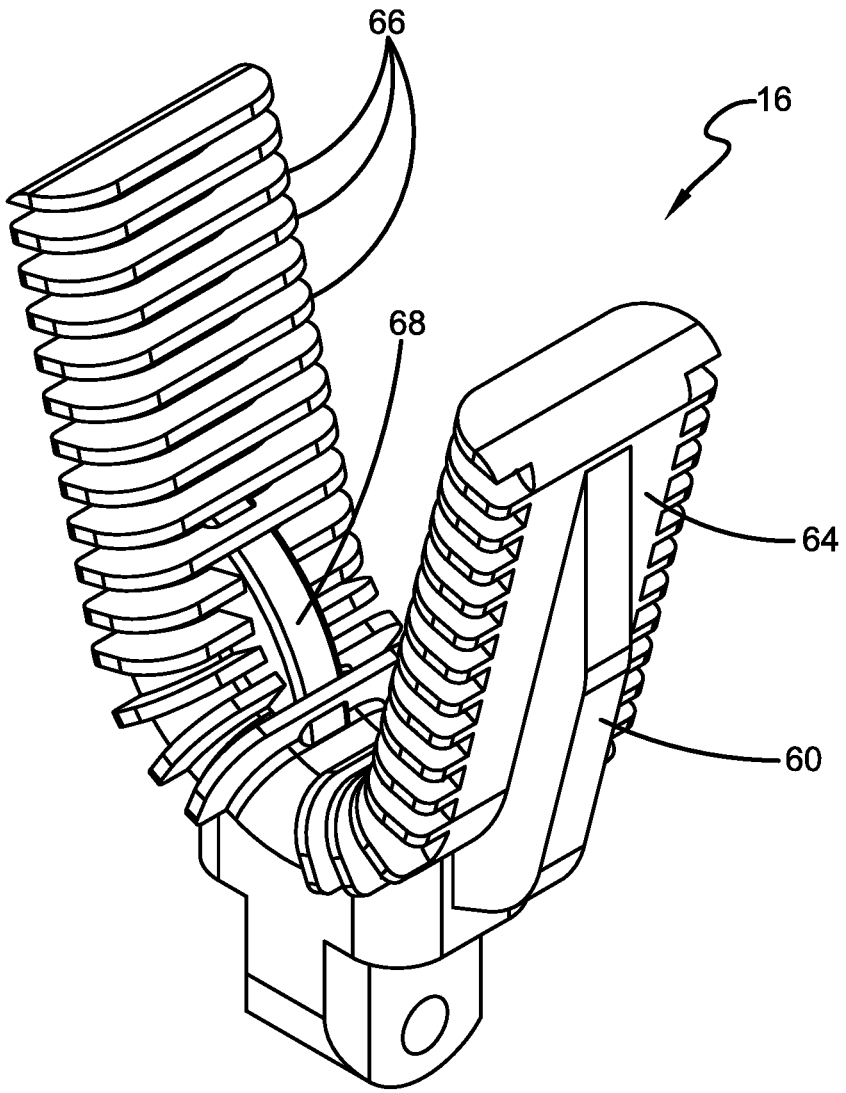
FIG. 9 is a perspective view of the U support showing the different materials used to form the body of the U support.
Figure 10:
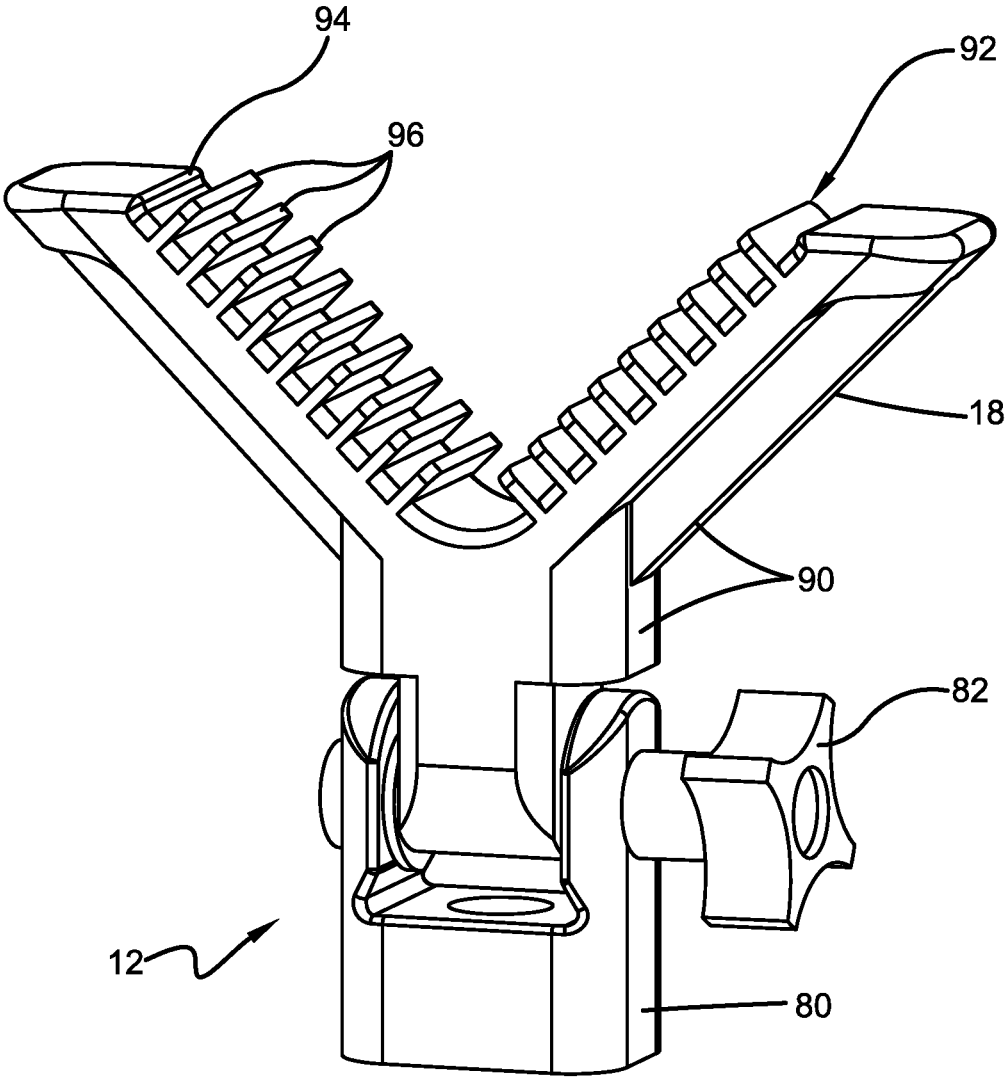
FIG. 10 is a perspective view of the V support assembly.
Figure 11:
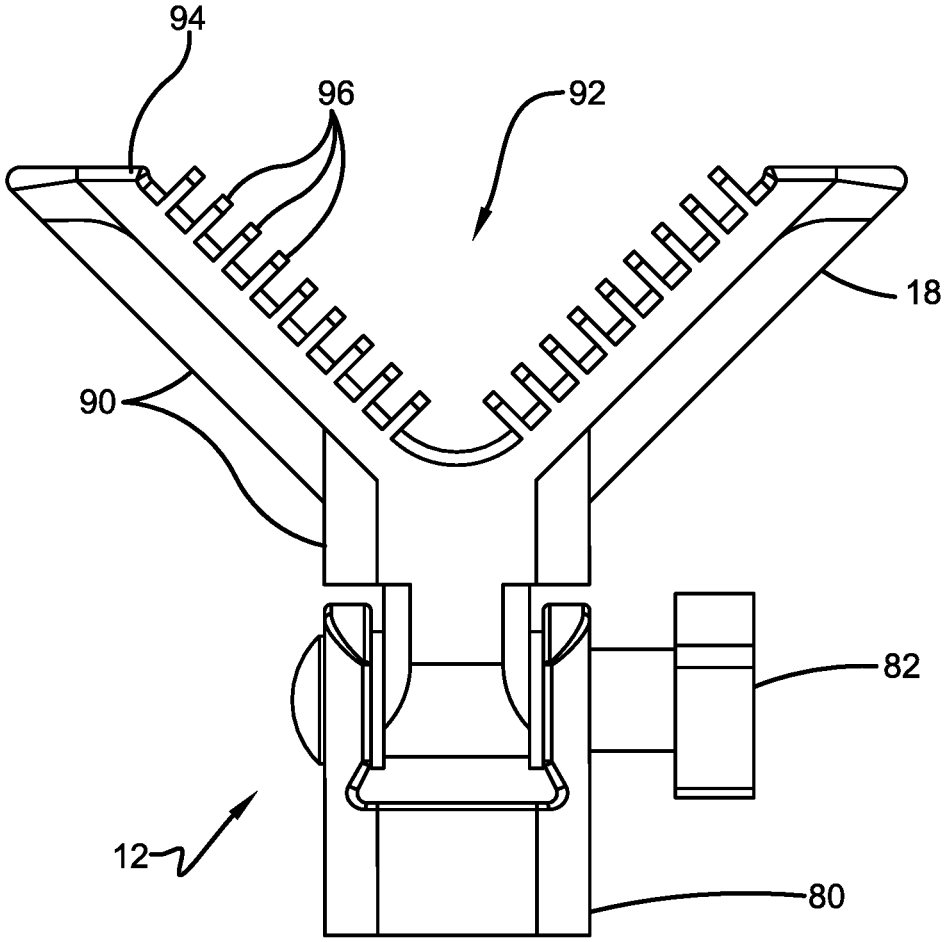
FIG. 11 is a front elevation view of the V support assembly.
Figure 12:
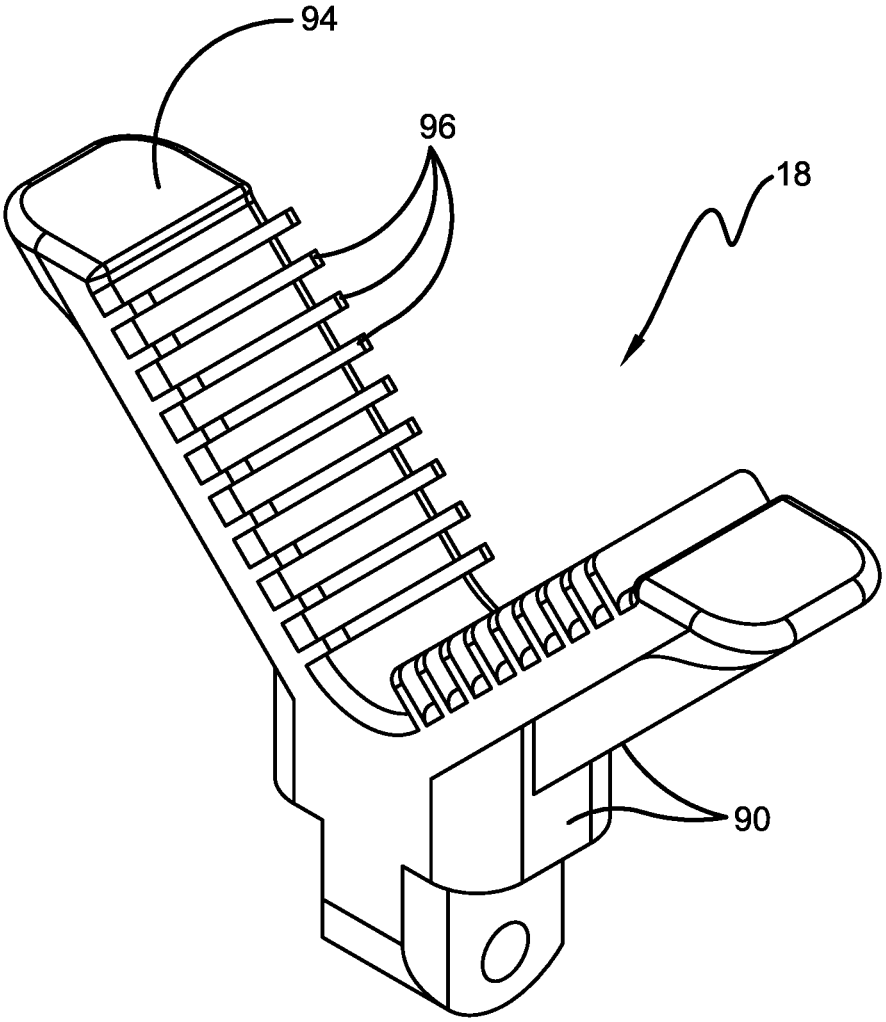
FIG. 12 is a perspective view of the V support showing the different materials used to form the body of the V support.
Figure 13:
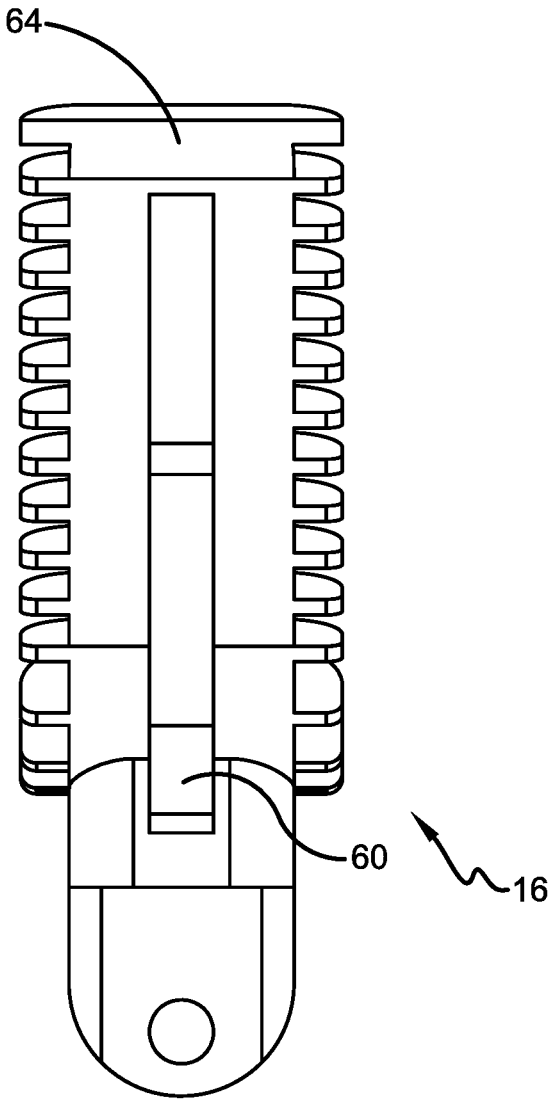
FIG. 13 is a side view of the U support.
Figure 14:
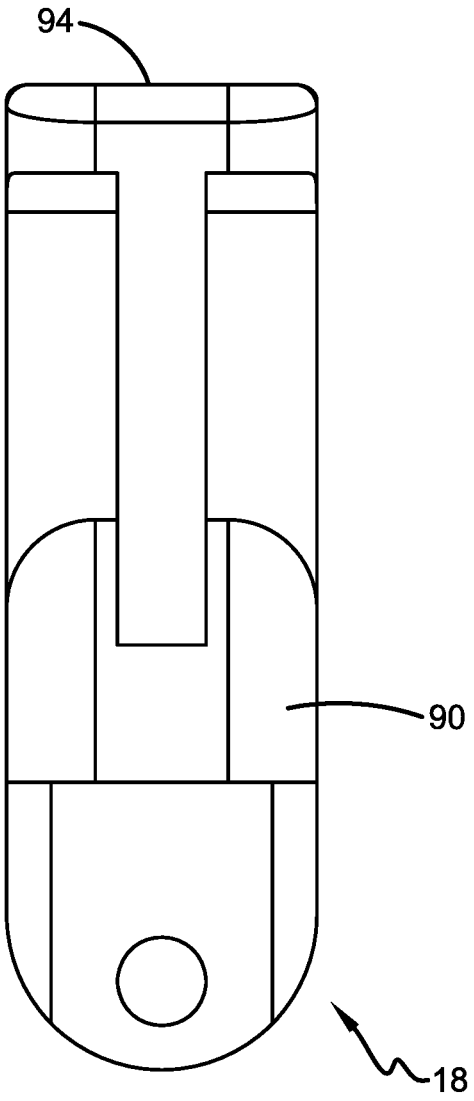
FIG. 14 is a side view of the V support.
Figure 15:
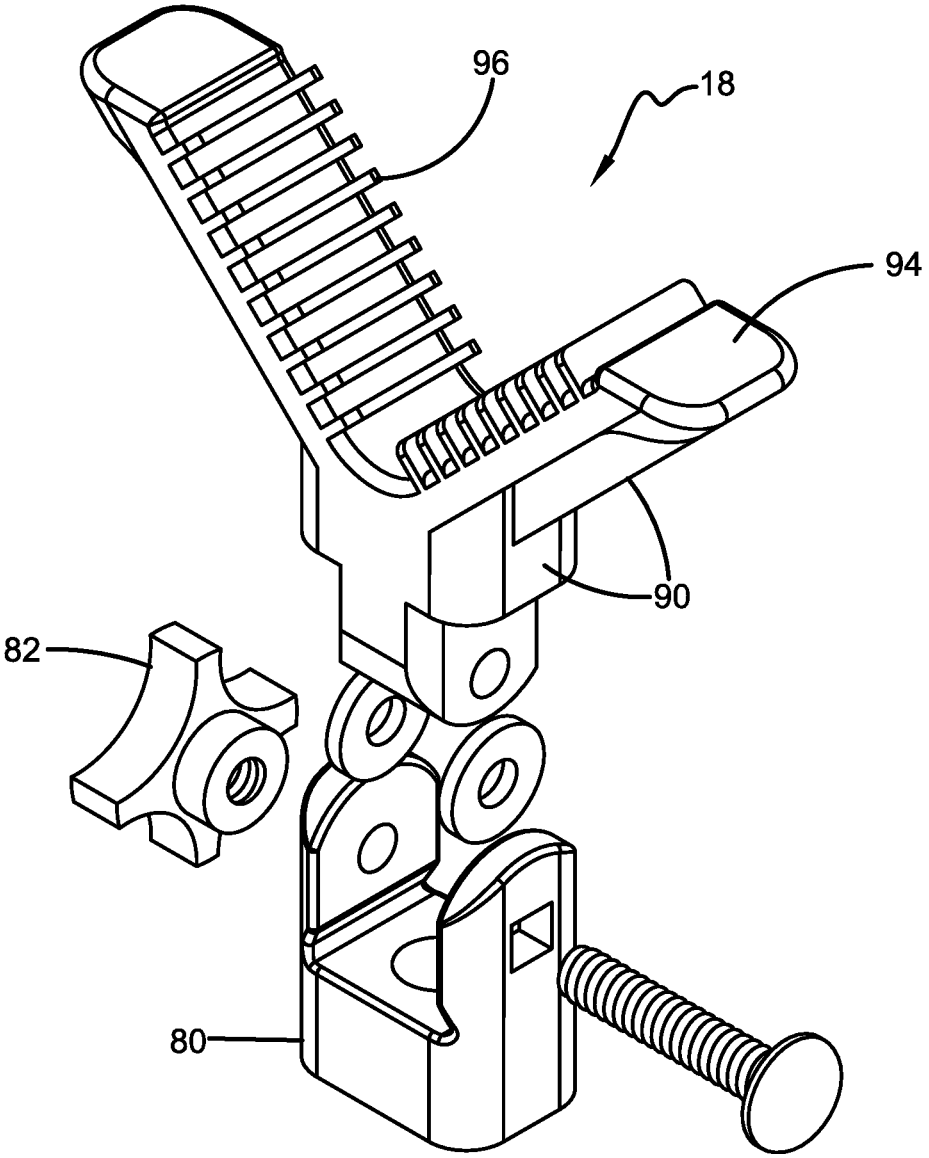
FIG. 15 is an exploded view of the V support assembly.

U support 16 has a generally U-shaped, rigid body member 60 that supports a soft, flexible, resilient cradle 62 that is engaged by the weapon when shooting rest 2 is used. Body member 60 can be made from a plastic or metal with cradle 62 being made from a resilient rubber or other suitable resilient polymer. Cradle 62 has a base 64 carried by rigid body member 60 and a plurality of spaced ribs 66 that project into the opening of U support 16. Ribs 66 are spaced apart a distance that is greater than their thickness. Each rib 66 projects from three sides of cradle base 64 such that each rib 66 projects forward, rear, and inwardly into the central portion of U support 16. A pair of flexible corner ribs 68 are disposed at the bottom corners of the cradle 62. The bottom corners are where the bottoms of the straight sides of the U support meet the curved bottom portion that defines the U shape of U support 16. Each of corner ribs 68 are disposed crosswise or perpendicular to ribs 66 and each is centered with respect to base 64 and ribs 66. Each corner rib 68 has a portion that projects above some ribs 66. Each corner rib 68 projects above the upper end of four ribs 66. The lowermost rib on each side of cradle base 64 has a lower end disposed under corner rib 68 and an upper end disposed above corner rib 68 as depicted in FIG. 8. Corner ribs 68 help support the stock of a weapon. The central portion of the curved bottom portion of cradle base 64 is free of ribs 66. The spaced-apart lower portions of corner ribs 68 define this central portion. This allows a thin portion of a stock to fit between corner ribs 68 and engage the upper surface of cradle base 64 at the central portion.

Base 50 has a threaded opening that receives a threaded member of a locking clamp 70 to secure U support assembly 10 to end 32.

FIGS. 10-12 and 14-15 show the structure of V support assembly 12. V support 18 is selectively pivotably carried on a V support base 80. A threaded clamp 82 is used to selectively lock the position of V support 18 with respect to V support base 80. The pivot provided by clamp 82 is about horizontal axis 28.

V support 18 has a generally V-shaped, rigid body member 90 that supports a soft, flexible, resilient cradle 92 that engages the weapon when shooting rest 2 is used. Body member 90 can be made from a plastic or metal with cradle 92 being made from a resilient rubber or other suitable resilient polymer. Cradle 92 has a base 94 carried by rigid body member 90 and a plurality of spaced ribs 96 that project into the opening of V support 18.

Base 80 has a threaded opening that receives a threaded member of a locking clamp 72 to secure V support assembly 12 to end 34.

Figure 16:
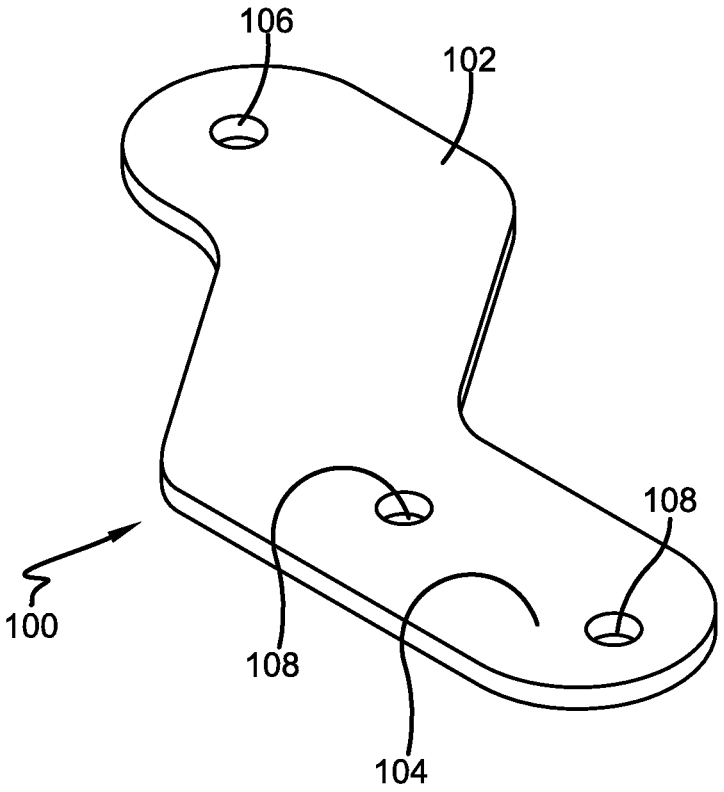
FIG. 16 depicts an exemplary camera mount used with the shooting rest.
Figure 17:
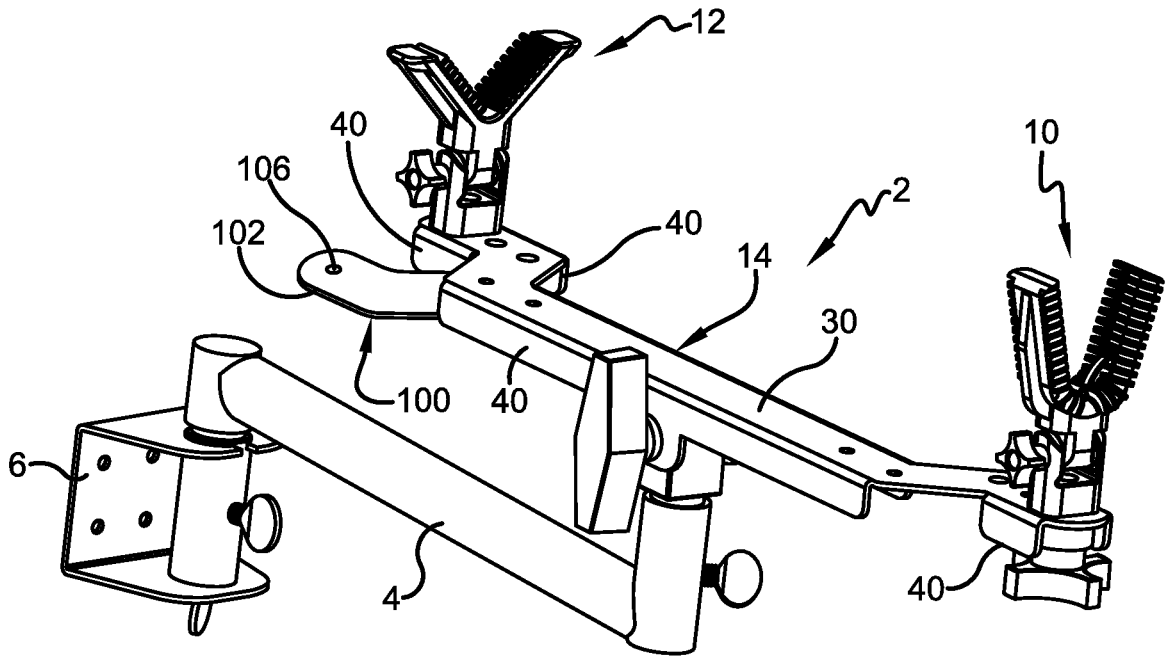
FIG. 17 shows the shooting rest carried at the end of the base.

FIGS. 16 and 17 depict a camera mount 100 that can be selectively used with shooting rest 2 to align a camera with the weapon supported by shooting rest 2 and that allows the camera to be moved along with shooting rest 2 and weapon. Camera mount 100 includes a body with first 102 and second 104 ends. Ends 102 and 104 can be parallel but offset in a stretched CZ' configuration. In another configuration, first 102 and second 104 ends are not parallel and body 100 is configured to locate first end 102 at a position sufficiently spaced from end 34 of base 14 to allow many cameras (such as a DSLR or a GoPro® camera) to be mounted to first end 102 without interfering with V support assembly 12. First end 102 defines an opening 106 sized to receive a camera mounting fastener (such as a threaded rod) that mounts a camera either above or below first end 102. In another configuration, a camera mounting fastener can be connected to first end 102. In a further configuration, the camera can be strapped to first end 102.

Second end 104 has a width that fits below central portion 30 of base 14 between sidewall portions 40. Second end 104 also has a thickness that is less than the heights of sidewall portions 40. Second end 104 defines at least one fastening opening 108 that receives a fastener that connects camera mount 100 to base 14 through one of the mounting openings defined by the end of central portion 30. In the exemplary configuration, a pair of spaced fastening openings 108 are used to secure camera mount 100 to base 14. The lateral offset between opening 106 and opening 108 can be the same as the offset between the center of central portion 30 and the center of end 34. In one exemplary configuration, a lateral offset of 1.75 inches is sufficient to provide space to mount cameras next to V support assembly 12.

An exemplary monopod 3 is depicted in FIG. 18 with an anchor assembly 120 that can be used to secure monopod 3 to a structure such as a shelf, a window sill, or a door frame in a hunting blind. Hinged arm 5 is carried by monopod 3 with shooting rest 2 supported by the outer end of hinged arm 5. Monopod 3 includes a plurality of leg portions 122 that selectively collapse and expand within one another to allow the height of monopod 3 to be adjusted. At least one of these portions is disposed above anchor assembly 120 so that the usable height of rest 2 can be adjusted to fit the user.

Anchor assembly 120 includes a clamp 130 that is connected to an adjustable holder 132. Clamp 130 defines a slot adapted to receive the edge of a shelf, a window sill, a door edge, and the like. Clamp 130 also includes first and second threaded members 134 that can be rotated to tighten against the item disposed within the slot to secure anchor 120 in place. These include finger knobs that allow them to be tightened and loosened manually without tools. Adjustable holder 132 includes first 140 and second 142 portions that selectively rotate with respect to each other. Second portion 142 is secured to clamp 130. First portion 140 carries a monopod holding ring 144 that can be tightened against monopod 3 with a threaded clamping bolt.

First and second lock bolts 150 selectively lock the rotational position of first portion 140 with respect to second portion 142. In the drawings, the slot of clamp 130 is disposed horizontal and the opening through monopod holding ring 144 is vertical such that anchor assembly 120 is configured to anchor a vertical monopod 3 to a horizontal member. In situations where either monopod 3 is not vertical or the member that is to be fit into clamp 130 is not horizontal, the angular positions of first 140 and second 142 portions can be adjusted to match. To make the adjustment, the user loosens bolts 150 and rotates portion 140 with respect to portion 142 and then tightens bolts 150 again. Bolts 150 are threaded to second portion 142 and extend through arc-shaped slots 152 defined by first portion 140.

Arm 5 includes three (an inner portion connected to a mount or an anchor, a middle portion, and an outer portion that carries shooting rest 2) arm sections 160 that are connected with pivot rods 162. Washers and lock nuts are used to provide secure but smooth movement between arm sections 160. Each arm section 160 includes spaced, alternating horizontal and vertical openings that reduce the weight of each arm section 160 and provide mounting locations for gear. The inner end of the inner portion of arm 5 includes a monopod mounting pin 164 while the outer end of the outer portion of arm 5 carries threaded mount 11. The outer arm portion is short enough to swing above the middle portion without hitting the inner portion so that the outer portion can rotate through 360 degrees of rotation to provide freedom of movement to shooting rest 2. A hunter using rest 2 at the outer end of arm 5 can move a weapon from a right hand opening in a blind, through an arc that sweeps the entire front window, over to a left hand opening without removing the weapon from rest 2.

Figure 25:
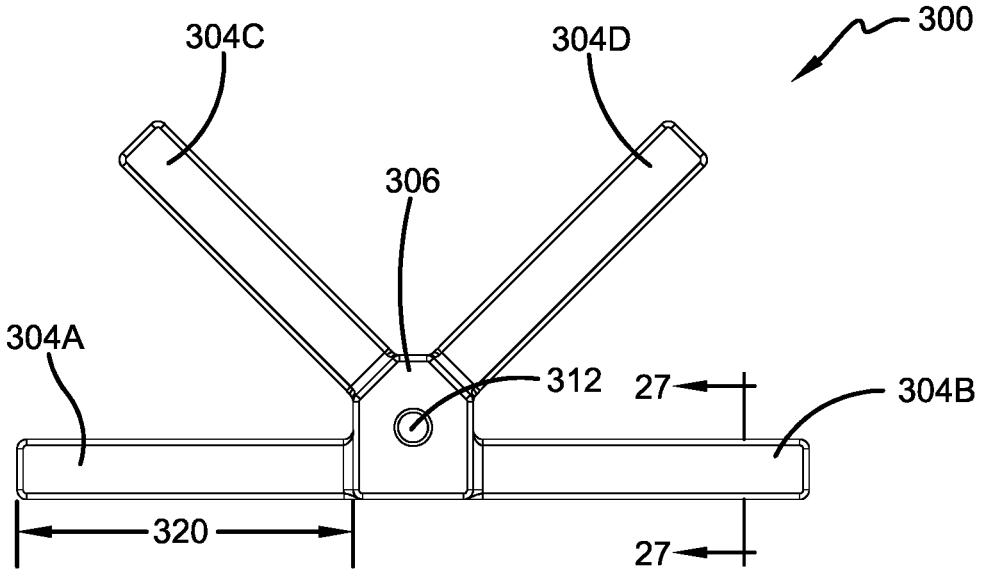
FIG. 25 is a bottom plan view of a first embodiment of a user-configurable support member.
Figure 26:
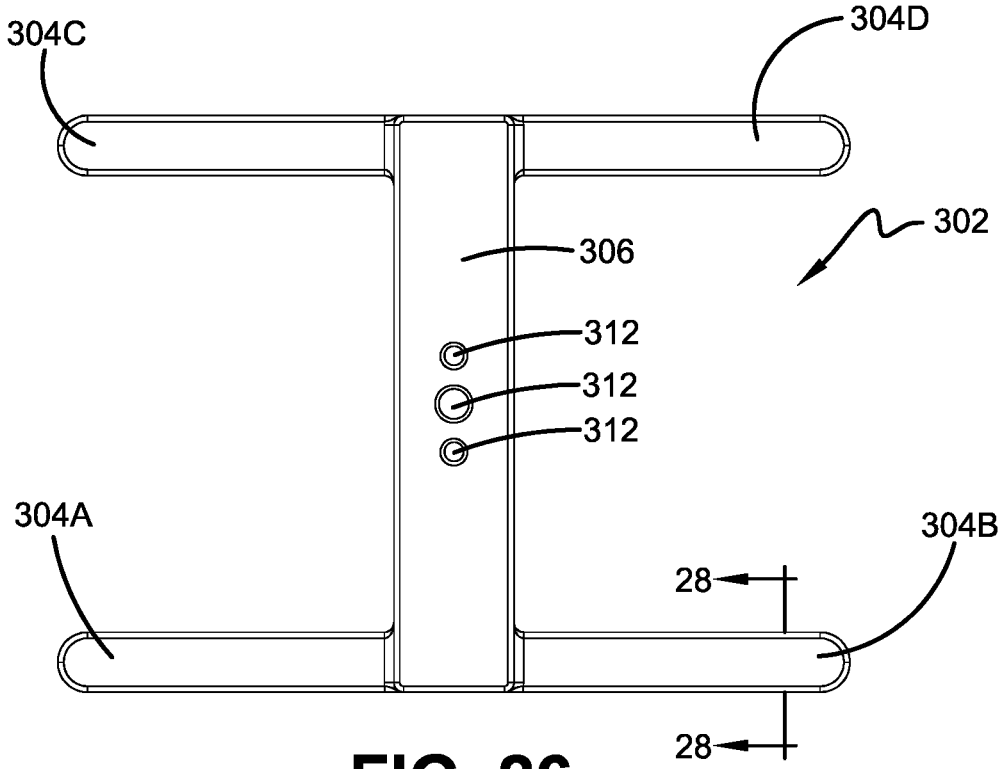
FIG. 26 is a bottom plan view of a second embodiment of a user-configurable support member.
Figure 27:
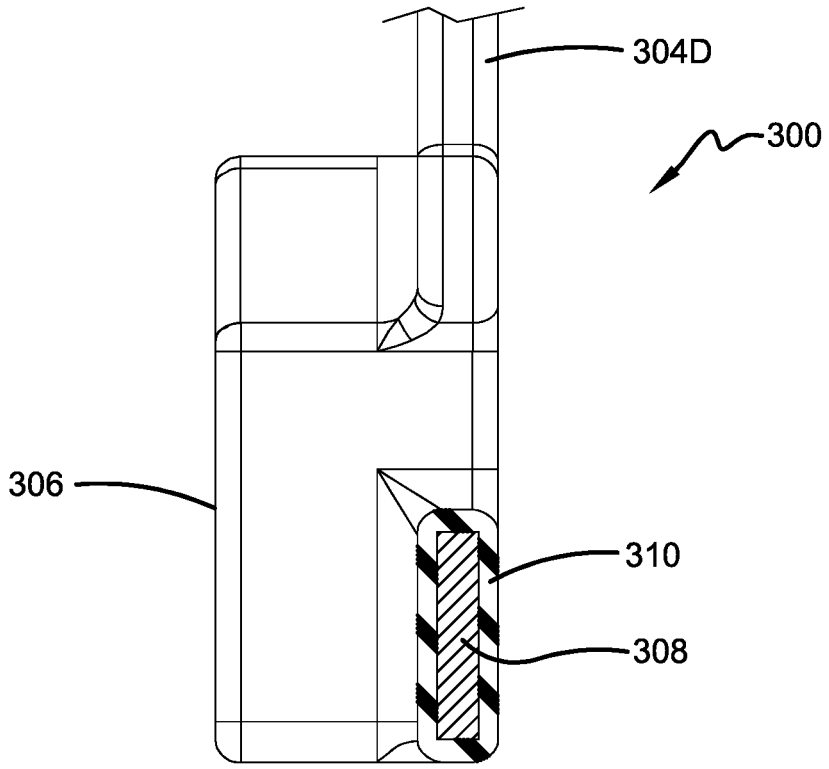
FIG. 27 is a section view taken along line 27-27 of FIG. 25.
Figure 28:
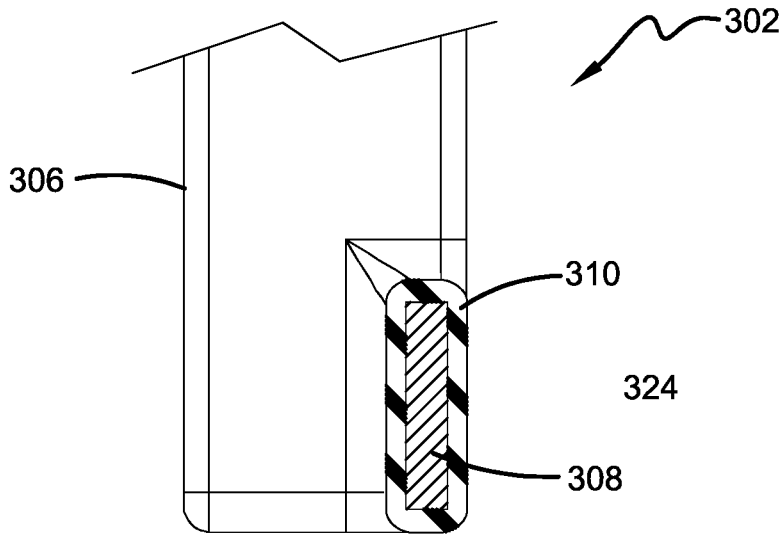
FIG. 28 is a section view taken along line 28-28 of FIG. 26.
Figure 29:
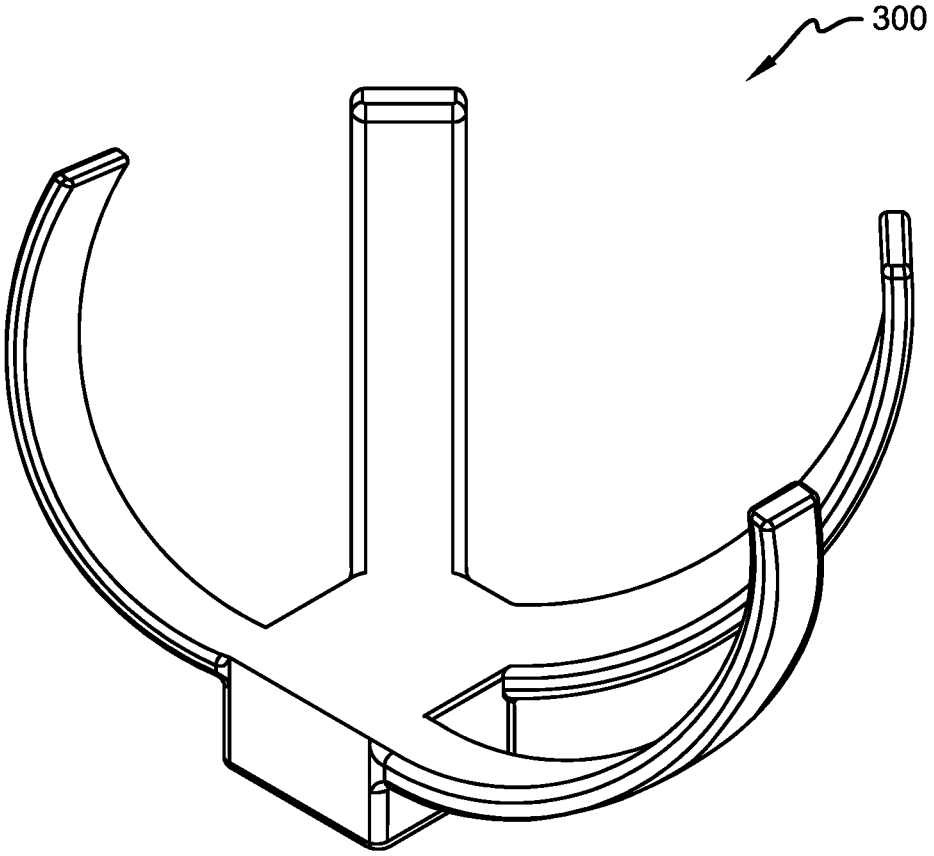
FIG. 29 is a perspective view of an exemplary configuration of the first embodiment of the user-configurable support member.

A first embodiment of a user-configurable support member or yoke is indicated generally by the number 300 in FIGS. 25, 27, and 29. A second embodiment of a user-configurable support member or yoke is indicated generally by the number 302 in FIGS. 26, 28, and 30. Each user-configurable support 300 and 302 include a plurality of pliable arms 304 that can be selectively bent to a shape determined by the user of the support. Arms 304 are configured to hold the determined shape. Exemplary supports 300 and 302 can have two to six arms 304 with the embodiments provided in the drawings having four arms 304. Arms 304 extend from a base 306. Arms 304 have no or little spring back or memory so that they maintain the selected configuration and provide support to the gun or cross bow being used with the configured support 300 or 302. Less than ten percent spring back after being bent is functional. The user can bend arms 304 to a desired configuration and then place the gun or cross bow in the support. Alternatively, the user can place the gun or cross bow on the support and then bend arms 304 around a portion of the weapon. Each arm 304 has an inner member 308. Inner member 308 can be a metal such as steel. Each support 300 and 302 has an outer protective layer 310. The outer protective layer can be a polymer. The outer protective layer can be a silicone or a rubber.

Support 300 includes four arms 304 designated as first 304A, second 304B, third 304C, and fourth 304D. Each of arms 304 extends from a base 306 that supports arms 304 and allows support 300 to be mounted to an arm 5 or a shooting rest 2. Base 306 can be made from the same material as inner members 308 or a metal like aluminum. As shown in FIGS. 27 and 29, the top surface of each coated arm 304 is level with the top surface of the coated base 306. First 304A and second 304B arms extend in opposite directions from opposite sides of the rear end of base 306. Arms 304A and 304B are parallel and share a longitudinal axis. Third 304C and fourth 304D arms extend in the shape of a V from the angled front corners of base 306. Arms 304C and 304D are arranged ninety degrees to one another. Arms 304A and 304C are arranged forty-five degrees to one another. Arms 304B and 304D are arranged forty-five degrees to one another. The connections between arms 304 and base 306 are all spaced apart. The user can choose to use just two of arms 304 or choose to use all four arms 304 at the same time as desired. Base 306 defines a mounting hole 312 sized to receive a ⅜ inch 16 UNC thread on a typical mounting screw 11. An exemplary configuration using all four arms 304 is shown in FIG. 29 wherein a user has bent the four arms 304 into upward curves.

Figure 30:
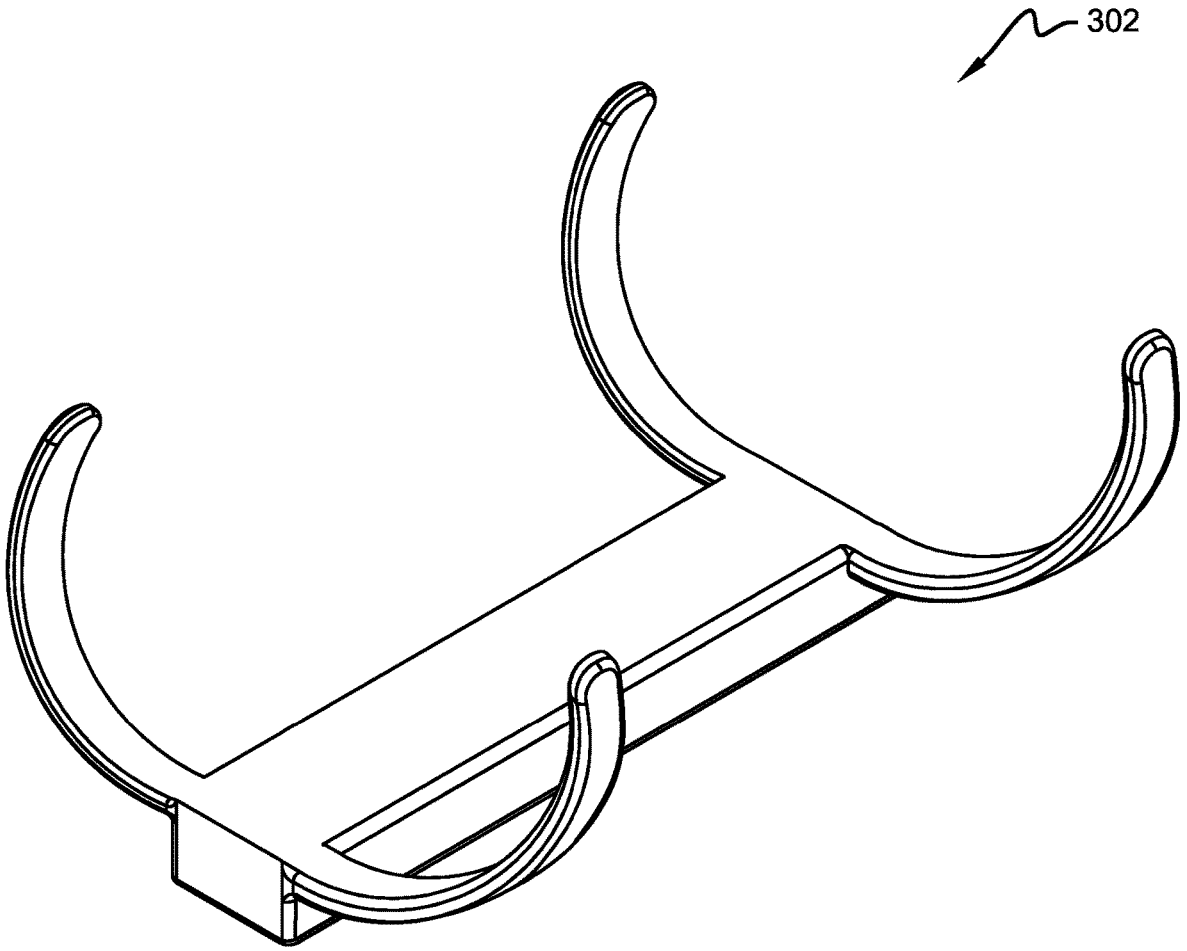
FIG. 30 is a perspective view of an exemplary configuration of the second embodiment of the user-configurable support member.

Support 302 includes four arms 304 designated as first 304A, second 304B, third 304C, and fourth 304D. Each of arms 304 extends from a base 306 that supports arms 304 and allows support 300 to be mounted to an arm 5 or a shooting rest 2. Base 306 can be made from the same material as inner members 308 or a metal like aluminum. As shown in FIGS. 28 and 30, the top surface of each coated arm 304 is level with the top surface of the coated base 306. First 304A and second 304B arms extend in opposite directions from opposite sides of the rear end of base 306. Arms 304A and 304B are parallel and share a longitudinal axis. Third 304C and fourth 304D arms extend in opposite directions from opposite sides of the front end of base 306. Arms 304A and 304B are parallel and share a longitudinal axis. The user can choose to use just two of arms 304 or choose to use all four arms 304 at the same time as desired. Base 306 defines three mounting holes 312 with the center hole being sized for a three-eighths inch 16 UNC thread and the two outer holes 312 being sized for a one quarter inch 20 UNC thread. An exemplary configuration using all four arms 304 is shown in FIG. 30 wherein a user has bent the four arms 304 into upward curves. Support 302 can be used with the forearm of a gun to provide spaced support along its length.

Each arm 304 is generally a long, thin member wherein the length 320 is longer than the width 322 which is greater than the thickness 324. Inner member 308 can have a rectangular or oval cross section. Arms 304 are intended to readily bend along axes parallel to the width dimension. An exemplary arm 304 has a length that is over five times its width. The width is over three times the thickness. For example, each arm with its outer protective layer can be 3.5 inches long, 0.625 inches wide, and 0.20 inches thick. In the configuration of support 300, base has a length of 1.5 inches, a width of 1.25 inches, and a thickness of 0.7 inches. In the configuration of support 302, base has a length of 6.0 inches, a width of 1.25 inches, and a thickness of 0.7 inches.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words “comprise” and “include” as well as variations of those words, such as "comprises," "includes," "comprising," and "including" are not intended to exclude additives, components, integers, or steps.

The invention claimed is:

1. A user-configurable weapon support member comprising:

a base having a top surface, a bottom surface, a first side, and a second side; the base defining at least one threaded mounting hole capable of receiving a threaded mounting screw; the threaded mounting hole extending through the bottom surface of the base;

a device capable of supporting the base from a stable structure; the device having a threaded screw threadedly received in the at least one threaded mounting hole of the base;

first, second, third, and fourth arms extending from the base;

each of the arms being pliable to allow each arm to be bent to and retained in a configuration determined by a user;

the first and third arms extending from the first side of the base and being spaced from each other;

the second and fourth arms extending from the second side of the base and being spaced from each other;

wherein the first and second arms extend in opposite directions from the base and wherein the third and fourth arms extend in opposite directions from the base; and each of the arms capable of being bent to a configuration that cradles a weapon on top of the base.

2. The support member of claim 1, wherein the base has a front end and a rear end; the first and second arms being connected to the base at the front end of the base and the third and fourth arms being connected to the base at the rear end of the base.

3. The support member of claim 2, wherein the first and second arms have a front edge that is even with the front end of the base.

4. The support member of claim 3, wherein the third and fourth arms have a rear edge that is even with the rear end of the base.

5. The support member of claim 4, wherein each of the arms has a top surface; and at each location where an arm extends from the base, the top surface of the arm being level with the top surface of the base.

6. The support member of claim 1, wherein each arm includes an inner member and a protective outer member.

7. The support member of claim 6, wherein the inner member is metal.

8. The support member of claim 7, wherein the metal is steel.

9. The support member of claim 6, wherein the protective outer member is a polymer.

10. The support member of claim 9, wherein the protective outer member is one of rubber and silicone.

11. The support member of claim 1, wherein each arm includes an inner member having a length that is longer than its width and its width longer than its thickness; the inner member being bendable about axes parallel with the width of the inner member.

12. The support member of claim 11, wherein the inner member is a metal.

13. The support member of claim 12, wherein the metal is steel.

14. The support member of claim 13, wherein the inner member is covered by a polymer.

* * * * *